US008668500B2

(12) United States Patent
Kobayashi

(10) Patent No.: US 8,668,500 B2
(45) Date of Patent: Mar. 11, 2014

(54) CONNECTION TERMINAL, METHOD FOR MANUFACTURING CONNECTION TERMINAL, AND SOCKET INCLUDING CONNECTION TERMINAL

(75) Inventor: Tomoki Kobayashi, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 117 days.

(21) Appl. No.: 13/490,725

(22) Filed: Jun. 7, 2012

(65) Prior Publication Data

US 2012/0315803 A1 Dec. 13, 2012

(30) Foreign Application Priority Data

Jun. 10, 2011 (JP) ..... 2011-130634

(51) Int. Cl.
*H01R 12/00* (2006.01)

(52) U.S. Cl.
USPC ..... 439/66; 439/83

(58) Field of Classification Search
USPC ..... 439/65, 66, 70, 71, 83, 85, 91, 161, 439/886; 361/760, 761, 787; 174/261, 262, 174/267
See application file for complete search history.

(56) References Cited

U.S. PATENT DOCUMENTS

| | | | | |
|---|---|---|---|---|
| 6,827,584 | B2 * | 12/2004 | Mathieu et al. | 439/66 |
| 7,127,811 | B2 * | 10/2006 | Mathieu et al. | 29/846 |
| 7,238,031 | B2 * | 7/2007 | Takai | 439/66 |
| 7,325,302 | B2 * | 2/2008 | Mathieu et al. | 29/874 |
| 7,458,816 | B1 * | 12/2008 | Mathieu et al. | 439/66 |
| 8,152,535 | B2 * | 4/2012 | Ihara | 439/66 |
| 8,179,692 | B2 * | 5/2012 | Ihara | 361/787 |
| 8,294,042 | B2 * | 10/2012 | Lee et al. | 174/262 |
| 2006/0286832 | A1 * | 12/2006 | Van Schuylenbergh et al. | 439/125 |
| 2010/0300742 | A1 | 12/2010 | Ihara et al. | |

FOREIGN PATENT DOCUMENTS

| | | |
|---|---|---|
| JP | 09-017535 | 1/1997 |
| JP | 2010-277829 | 12/2010 |

* cited by examiner

*Primary Examiner* — Thanh Tam Le
(74) *Attorney, Agent, or Firm* — IPUSA, PLLC

(57) ABSTRACT

A connection terminal for connecting a first connection object and a second connection object and including a metal plate having a resilient property, an insulating layer covering at least a part of the metal plate, a conductive layer formed on at least a part of the insulating layer, first and second fixing parts configured to be fixed to corresponding adjacent pads of the second connection object, and first and second connection parts configured to contact corresponding adjacent pads of the first connection object. The first fixing part and the first connection part are positioned opposite from each other. The second fixing part and the second connection part are positioned opposite from each other. The first and the second connection parts are faced outward to the first connection object. The first and the second fixing parts are faced outward to the second connection object.

12 Claims, 27 Drawing Sheets

CONNECTION TERMINAL, METHOD FOR MANUFACTURING CONNECTION TERMINAL, AND SOCKET INCLUDING CONNECTION TERMINAL

CROSS-REFERENCE TO RELATED APPLICATIONS

This application is based upon and claims the benefit of priority of the prior Japanese Patent Application No. 2011-130634 filed on Jun. 10, 2011, the entire contents of which are incorporated herein by reference.

FIELD

The embodiments discussed herein are related to a connection terminal for connecting first and second target connection objects, a method for manufacturing the connection terminal, and a socket including the connection terminal.

BACKGROUND

A so-called land grid array (LGA) semiconductor package has a surface on one side on which pads are arranged in a grid pattern. The pads are connected to, for example, a motherboard. For example, the pads are connected by using an LGA socket having a resilient connection terminal(s) penetrating through a resin substrate. Various modifications are made to the LGA semiconductor package, so that high frequency signals of the LGA semiconductor package are maintained having satisfactory transmission characteristics. One example is described below.

FIG. 1 is a bottom view illustrating an example of a pad arrangement of a semiconductor package 200 according to a related art example. The semiconductor package 200 is a so-called LGA package having a bottom surface on which pads are arranged in a grid pattern. Pads 210G are electrically connected to a reference potential of the semiconductor package 200. Pads 210S are used for a single end signal. The pads 210G and the pads 2105 are alternately arranged. For the sake of convenience, the pads 210G are illustrated with a matte surface in FIG. 1.

FIG. 2 is a bottom view illustrating another example of a pad arrangement of a semiconductor package 300 according to a related art example. The semiconductor package 300 is a so-called LGA package having a bottom surface on which pads are arranged in a grid pattern. Pads 310G are electrically connected to a reference potential of the semiconductor package 300. Two pads 310G are consecutively arranged on the semiconductor package 300. Pad 310S are used for a differential end signal. Two pads 3105 are consecutively arranged on the semiconductor package 300. Two pads 310S are consecutively arranged for increasing the bond among signals transmitted from each of the pads 310S and cancelling out noise components among the pads 310S. Two of the pads 310G and two of the pads 310S are alternately arranged. For the sake of convenience, the pads 310G are illustrated with a matte surface in FIG. 2.

On the other hand, it is common for connection terminals of the LGA socket to be separately exposed to the atmosphere. Therefore, unless the connection terminal of the LGA is shielded at the GND, problems such as mismatch of characteristic impedance may occur and adversely affect transmission characteristics of high frequency signals. Thus, it is preferable to shield each of the connection terminals of the LGA socket at the GND, so that high frequency signals can maintain satisfactory transmission characteristics in correspondence with the pad arrangements illustrated in FIGS. 1 and 2.

[Patent Document 1]

Japanese Laid-Open Patent Publication No. 2010-277829

Japanese Laid-Open Patent Publication No. 09-017535

The width of a data bus and the number of channels are increasing due to the increasing speed of semiconductor packages whereas the pitch between connection terminals of the LGA is becoming narrower due to size reduction of the semiconductor package. However, it is difficult to reduce the pitch between connection terminals shielded at the ground.

SUMMARY

According to an aspect of the invention, there is provided a connection terminal for connecting a first connection object and a second connection object, the connection terminal including: a metal plate having a resilient property; an insulating layer covering at least a part of the metal plate; a conductive layer formed on at, least a part of the insulating layer; first and second fixing parts configured to be fixed to corresponding adjacent pads of the second connection object; and first and second connection parts configured to contact corresponding adjacent pads of the first connection object; wherein the first fixing part and the first connection part are positioned opposite from each other; wherein the second fixing part and the second connection part are positioned opposite from each other; wherein the first and the second connection parts are faced outward to the first connection object; wherein the first and the second fixing parts are faced outward to the second connection object.

The object and advantages of the invention will be realized and attained by means of the elements and combinations particularly pointed out in the claims.

It is to be understood that both the foregoing generation description and the followed detailed description are exemplary and explanatory and are not restrictive of the invention, as claimed.

DESCRIPTION OF EMBODIMENTS

Figure 1:
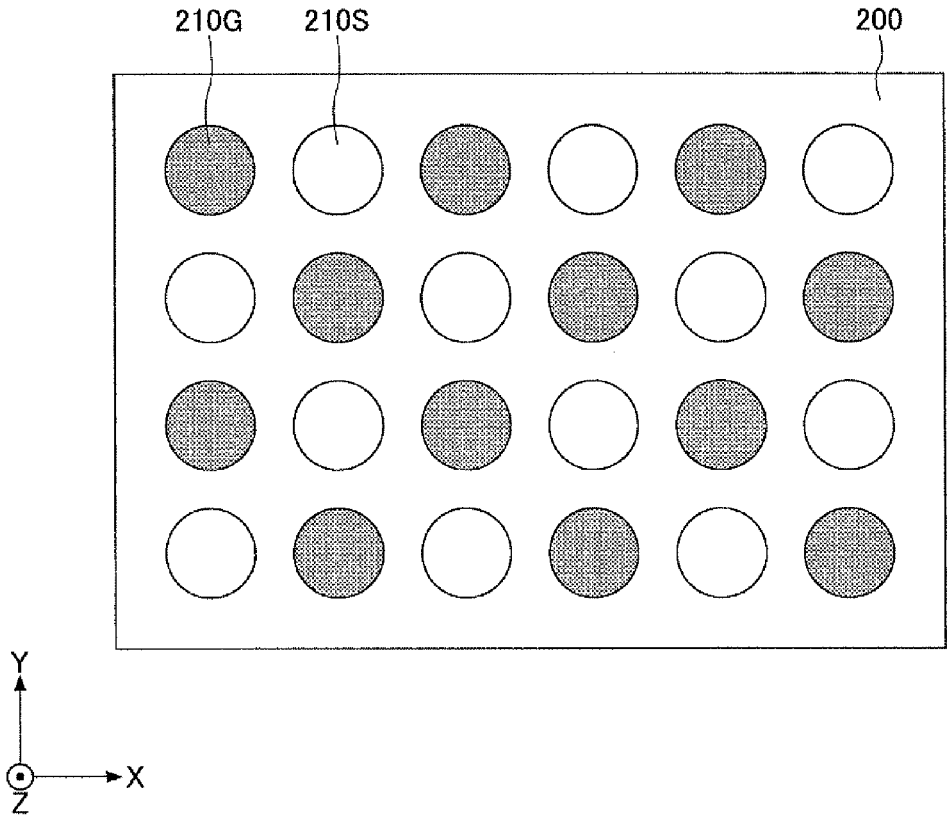
FIG.1 RELATED ART
FIG. 1 is a bottom view illustrating a pad arrangement of a semiconductor package according to a related art example.
Figure 2:
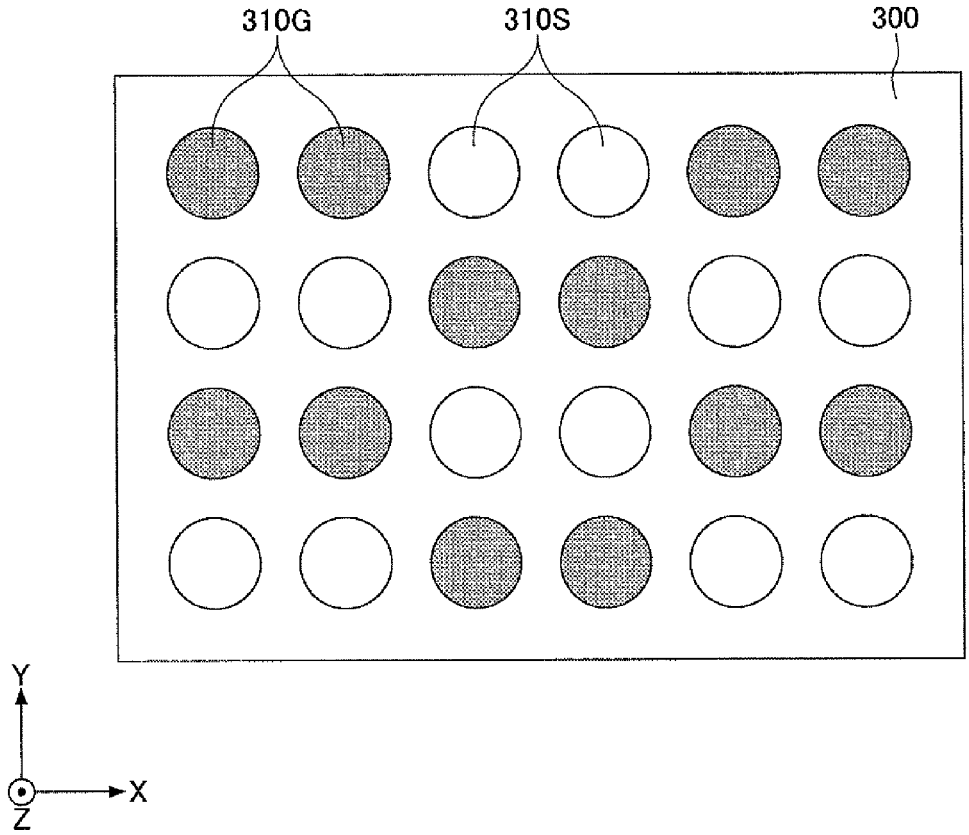
FIG.2 RELATED ART
FIG. 2 is a bottom view illustrating a pad arrangement of a semiconductor package according to another related art example.

In the following, embodiments of the present invention are described with reference to the accompanying drawings. Through the drawings of the embodiments, like components are denoted by like reference numerals and might not be repeatedly described.

In the following embodiments and modified examples, examples of a semiconductor package and a substrate are described having a rectangular shape in a plan view. However, the shapes of the semiconductor package and the substrate from the plan view may be other shapes.

First Embodiment

[Structure of Socket According to First Embodiment]

Figure 3:
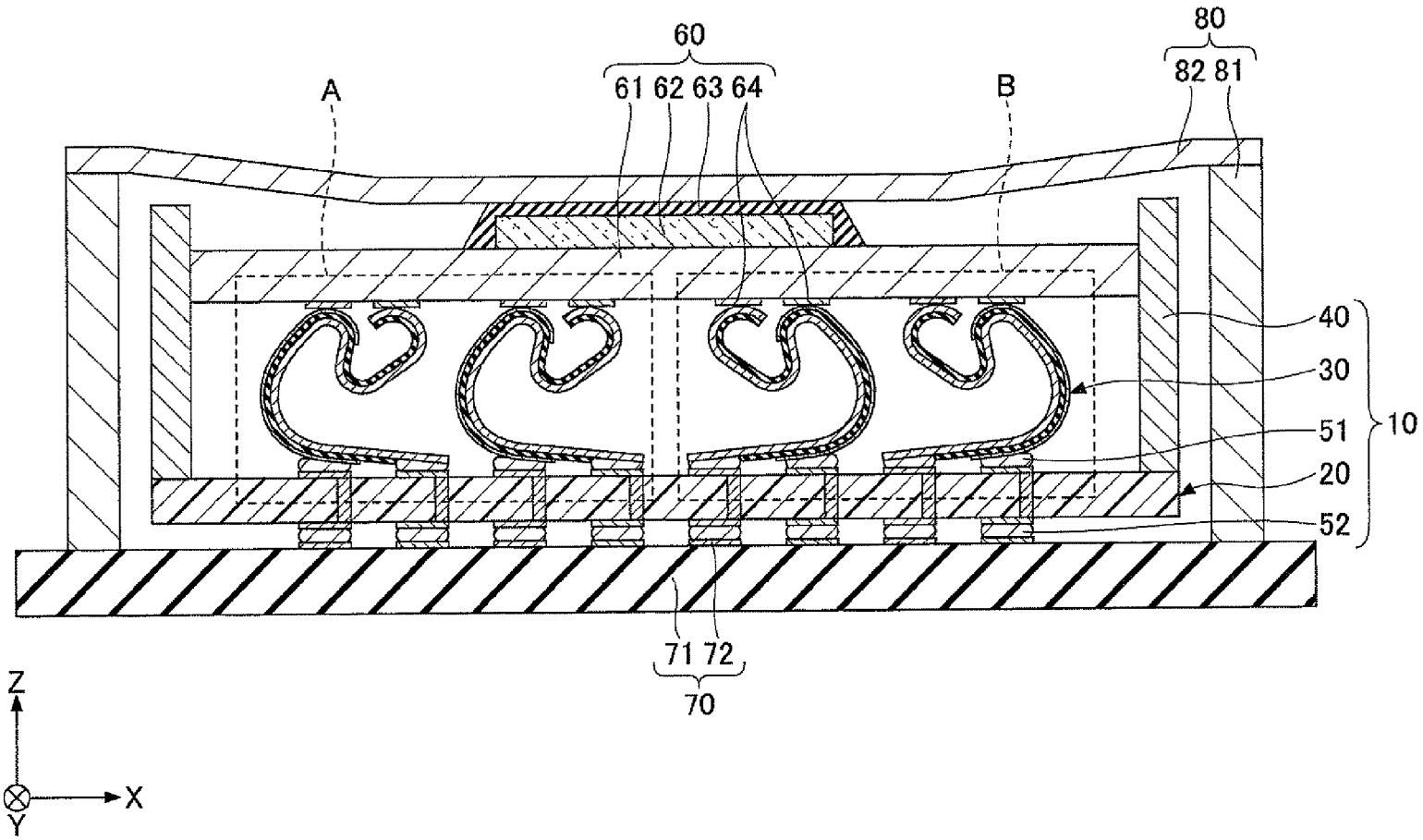
FIG. 3 is a cross-sectional view illustrating a socket according to a first embodiment of the present invention.
Figure 4:
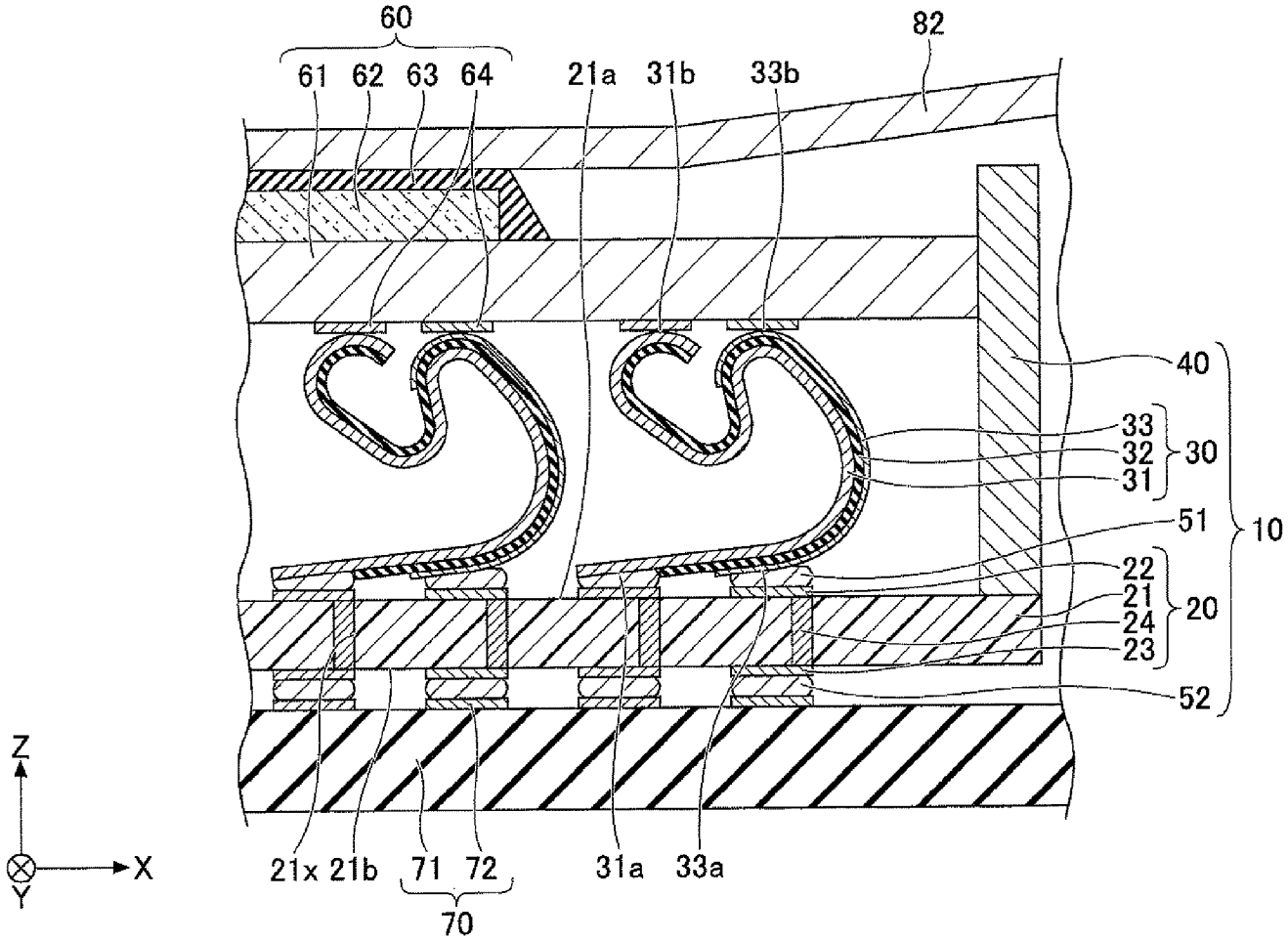
FIG. 4 is an enlarged cross-sectional view illustrating a portion of FIG. 3.
Figure 5:
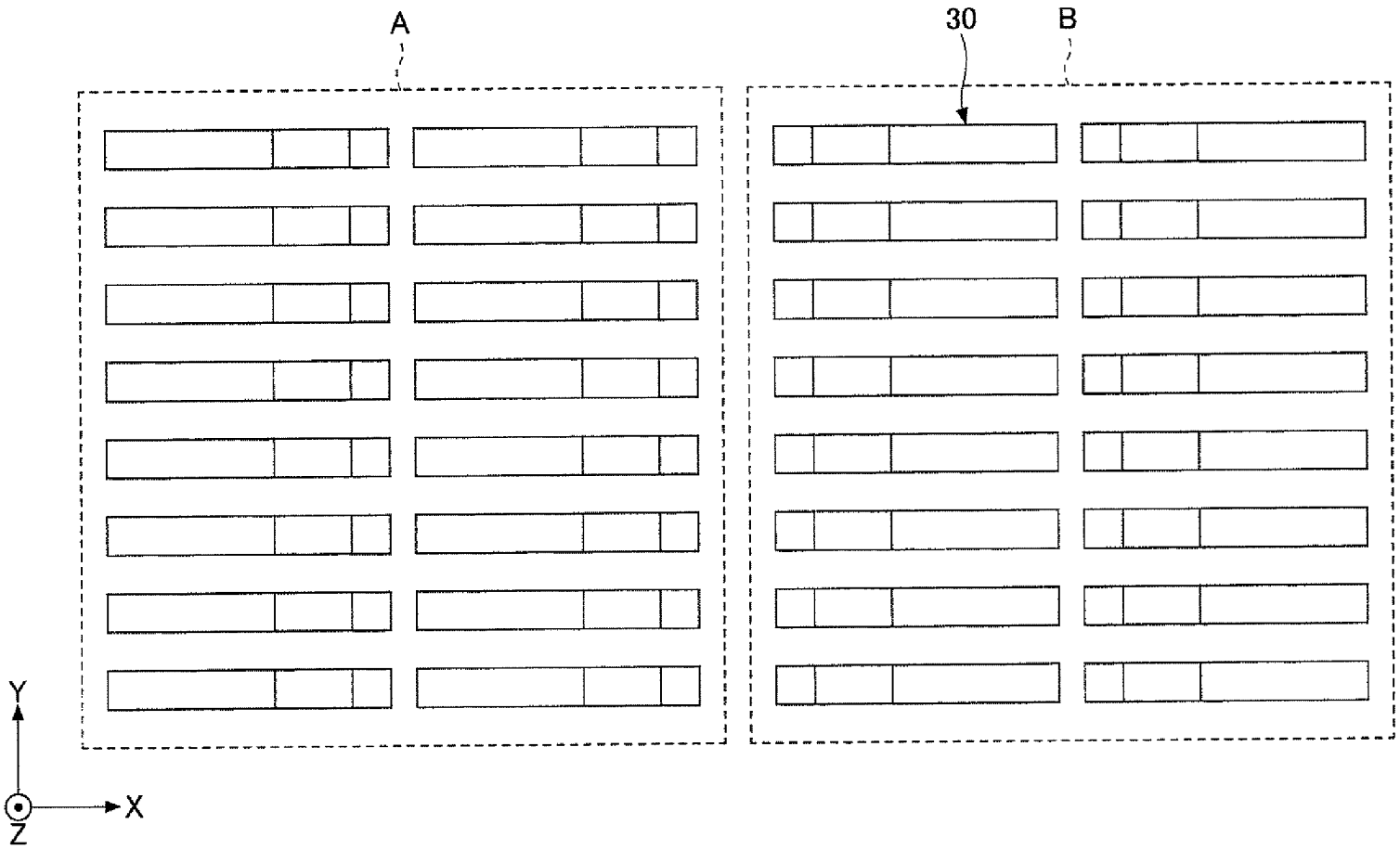
FIG. 5 is an enlarged plan view illustrating a portion of FIG. 3.

FIG. 3 is a cross-sectional view illustrating a socket according to a first embodiment of the present invention. FIG. 4 is an enlarged cross-sectional view illustrating a portion of FIG. 3. FIG. 5 is an enlarged plan view illustrating a portion of FIG. 3. In FIGS. 3-5, direction X indicates a direction in which connection terminals 30 are arranged, direction Y indicates a direction that is perpendicular to the direction X and parallel to a first main surface 21*a* of a substrate body 21, and direction Z indicates a direction that is perpendicular to the first main surface 21*a* of the substrate body 21. FIGS. 3 and 4 illustrate a cross section that is parallel to an X-Z plane of FIG. 5. FIG. 5 only illustrates the connection terminals 30.

In FIGS. 3-5, a socket 10 includes a substrate 20, connection terminals 30, a positioning part 40, and bonding parts 51, 52. Reference numeral 60 indicates a first connection object (in this embodiment, a semiconductor package). Reference numeral 70 indicates a second connection object (in this embodiment, a mounting substrate such as a motherboard). Reference numeral 80 indicates a housing. The semiconductor package 60 is electrically connected to the mounting substrate 70 by way of the socket 10 in a separable state (unfixed state). Although the first connection object in this embodiment is the semiconductor package 60, the first connection object may be, for example, a wiring substrate including a semiconductor chip.

The substrate 20 of the socket 10 includes the substrate body 21 including the first main surface 21*a* and a second main surface 21*b*. Further, the substrate 20 has a first conductive layer 22 formed on the first main surface 21*a* of the substrate body 21 and a second conductive layer 23 formed on the second main surface 21*b*. Further, the substrate 20 has via wirings 24 formed inside corresponding penetration holes 21*x* penetrating the substrate body 21 from the first main surface 21*a* to the second main surface 21*b*. A first solder resist layer, which includes opening parts exposing portions of the first conductive layer 22, may be formed on the first main surface 21*a* of the substrate body 21. A second solder resist layer, which includes opening parts exposing portions of the second conductive layer 23, may be formed on the second main surface 21*b* of the substrate body 21.

The first conductive layer 22 and the second conductive layer 23 are electrically connected to each other through the via wirings 24. The penetration hole 21*x* need not be filled with the via wiring 24. The first conductive layer 22 functions as pads to be connected to first and second fixing parts 31*a*, 33*a* of the connection terminal 30 (described in detail below). The second conductive layer 23 functions as pads to be connected to the mounting substrate 70. The pitch between the first conductive layers (pads) 22 may be, for example, approximately 1.2 mm to 2.0 mm.

The substrate body 21 is for fixing the connection terminals 30 thereon. For example, a flexible film-like substrate including polyimide resin or a liquid crystal polymer may be used as the substrate body 21. Alternatively, a rigid substrate (e.g., FR-4 material) formed by impregnating a glass cloth with an insulating resin (e.g., epoxy type resin) may be used as the substrate body 21. The thickness of the substrate body 21 may be, for example, approximately 100 μm to 800 μm.

For example, copper (Cu) may be used as the material of the first conductive layer 22, the second conductive layer 23, and the via wirings 24. The thickness of the first and the second conductive layers 22, 23 may be, for example, approximately 5 μm to 50 μm. For example, the first conductive layer 22, the second conductive layer 23, and the via wirings 24 may be formed by using various wiring forming methods such as a semi-additive method or a subtractive method.

The connection terminal 30 is a resilient conductive member. The first and the second fixing parts 31*a*, 33*a* are formed on a first end of the connection terminal 30. The first and the second fixing parts 31*a*, 33*a*, which are positioned adjacent to the first conductive layer 22, are electrically and mechanically connected to corresponding first conductive layers (pads) 22 interposed by the bonding parts 51. First and second connection parts 31*b*, 33*b* (described in detail below) are formed on a second end of the connection terminal 30. The first and the second connection parts 31*b*, 33*b*, which are positioned adjacent to the below-described pads 64 of the semiconductor package 60, are in contact with the pads 64 in a separable state (unfixed state). The first and the second connection parts 31*b*, 33*b* are electrically connected to the adjacent pads 64.

The connection terminals 30 arranged in an area A and the connection terminals 30 arranged in an area B are positioned substantially facing each other. By this arrangement, a reaction force generated in a horizontal direction (direction other than direction Z) can be reduced in a case where a pressing force is applied to the connection terminals 30 in direction Z. This is particularly effective in a case where the number of connection terminals 30 is large. In a case where the reaction force generated in the horizontal direction is not a problem (e.g., a case where the number of connection terminals 30 is relatively small), the connection terminals 30 arranged in the area A and the connection terminals 30 arranged in the area B may be positioned facing the same direction. The structure of the connection terminal 30 is described in further detail below.

The bonding parts 51 are formed on the first conductive layers 22. The bonding parts 51 electrically and mechanically connect the first and the second fixing parts 31*a*, 33*a* of the connection terminal 30 and the first conductive layers 22 adjacent to the first and the second fixing parts 31*a*, 33*a*. For example, a conductive material such as solder or a conductive resin paste (e.g., silver (Ag) paste) may be used as the material of the bonding part 51. In a case where solder is used as the material of the bonding part 51, the solder may be, for example, an alloy including lead (Pb), an alloy including tin (Sn) and copper (Cu), an alloy including tin (Sn), silver (Ag), and copper (Cu), an alloy including tin (Sn) and antimony (Sb), an alloy including tin (Sn), silver (Ag), copper (Cu), and antimony (Sb), or an alloy including tin (Sn), silver (Ag), bismuth (Bi), and indium (In).

The positioning part 40 is a member having, for example, an epoxy type resin as a main component. The positioning part 40 has a frame-like shape from a plan view. A bottom surface of the positioning part 40 is attached to an outer rim part of the first main surface 21*a* of the substrate body 21 with, for example, an adhesive agent. Alternatively, the positioning part 40 may be mechanically attached to the substrate 20 with, for example, a screw. The shape of a space formed by inner side surfaces of the positioning part 40 from a plan view is substantially the same as the shape of the substrate 61 of the below-described semiconductor package 60 from a plan view. The space formed by the inner side surfaces of the positioning parts 40 has a shape enabling the semiconductor package 60 to be inserted therein.

In a state where the substrate 61 is inserted into the space formed by the inner side surfaces of the positioning part 40, the inner side surface of the positioning part 40 contacts a side surface of the substrate 61 and secures the positions of the semiconductor package 60 and the socket 10. Thereby, adjacent pads 64 of the semiconductor package 60 contact the respective first and the second connection parts 31*b*, 33*b* of the socket 10. In addition to having a function of securing the position of the semiconductor package 60 and the socket 10, the positioning part 40 also has a function of reinforcing the strength of the substrate 20.

It is, however, to be noted that the positioning part 40 may be omitted from the socket 10. For example, instead of providing the positioning part 40, the socket 10 may have the below-described frame part 81 of the housing 80 that secures the position of the semiconductor package 60.

The bonding parts 52 electrically and mechanically connect the second conductive layer 23 of the substrate 20 and a conductive layer (pads) 72 of the mounting substrate 70. For example, a conductive material such as solder or a conductive resin paste (e.g., silver (Ag) paste) may be used as the material of the bonding part 52. In a case where solder is used as the material of the bonding part 52, the solder may be, for example, an alloy including lead (Pb), an alloy including tin (Sn) and copper (Cu), an alloy including tin (Sn), silver (Ag), and copper (Cu), an alloy including tin (Sn) and antimony (Sb), an alloy including tin (Sn), silver (Ag), copper (Cu), and antimony (Sb), or an alloy including tin (Sn), silver (Ag), bismuth (Bi), and indium (In).

It is, however, to be noted that the bonding parts 52 may be omitted from the socket 10. For example, instead of using the bonding parts 52, solder or bumps formed of a conductive resin adhesive agent may be provided on the conductive layer 72 of the mounting substrate 70.

Next, the semiconductor package (first connection object) 60, the mounting substrate (second connection object (e.g., motherboard)) 70, and the housing 80 are described. The semiconductor package 60 is a so-called LGA (Land Grid Array) semiconductor package which includes the substrate 61, a semiconductor chip 62, a sealing resin 63, and the pads 64. The substrate 61 has, for example, a substrate body including an insulating resin on which an insulating layer, a wiring pattern, and a via wiring or the like (not illustrated) are formed.

The substrate 61 includes first and second surfaces. The semiconductor chip 62 including, for example, silicon is mounted on the first surface of the substrate 61. The pads 64 are formed on the second surface of the substrate 61.

Figure 6:
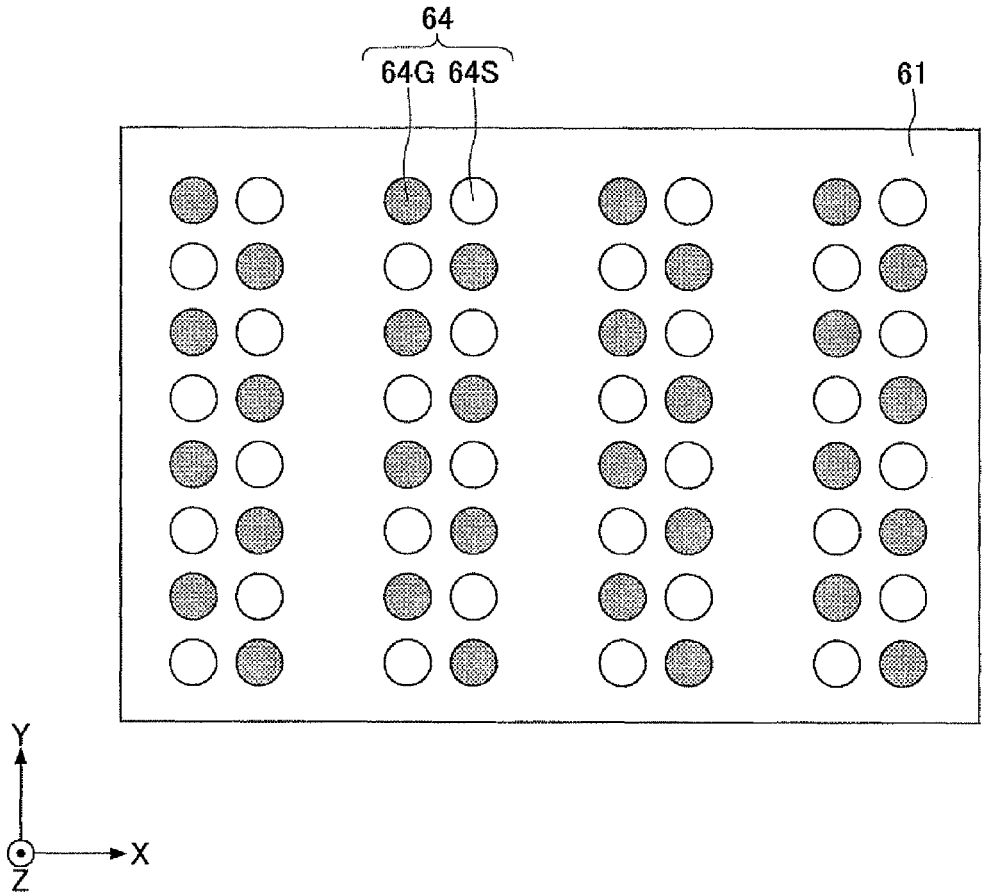
FIG. 6 is a bottom view illustrating an example of a pad arrangement of a semiconductor package according to the first embodiment of the present invention.

The pads 64, which are a part of a wiring pattern used for transmitting electric signals, may be arranged as illustrated in FIG. 6. With reference to FIG. 6, each of the pads 64 includes a pad 64G that is electrically connected to a reference potential (GND) of the semiconductor package 60 and a pad 64S that is used for transmitting single end signals. The pads 64G and the pads 64S are alternately arranged. For the sake of convenience, the pads 64G are illustrated with a matte surface in FIG. 6. Although all of the pads illustrated in FIG. 6 are either the pad 64G or the 64S, other pads for performing operations of the semiconductor package 60 may also be arranged in a part(s) of the wiring pattern of the semiconductor package 60 such as pads to be electrically connected to a power line of the semiconductor package 60.

Figure 7:
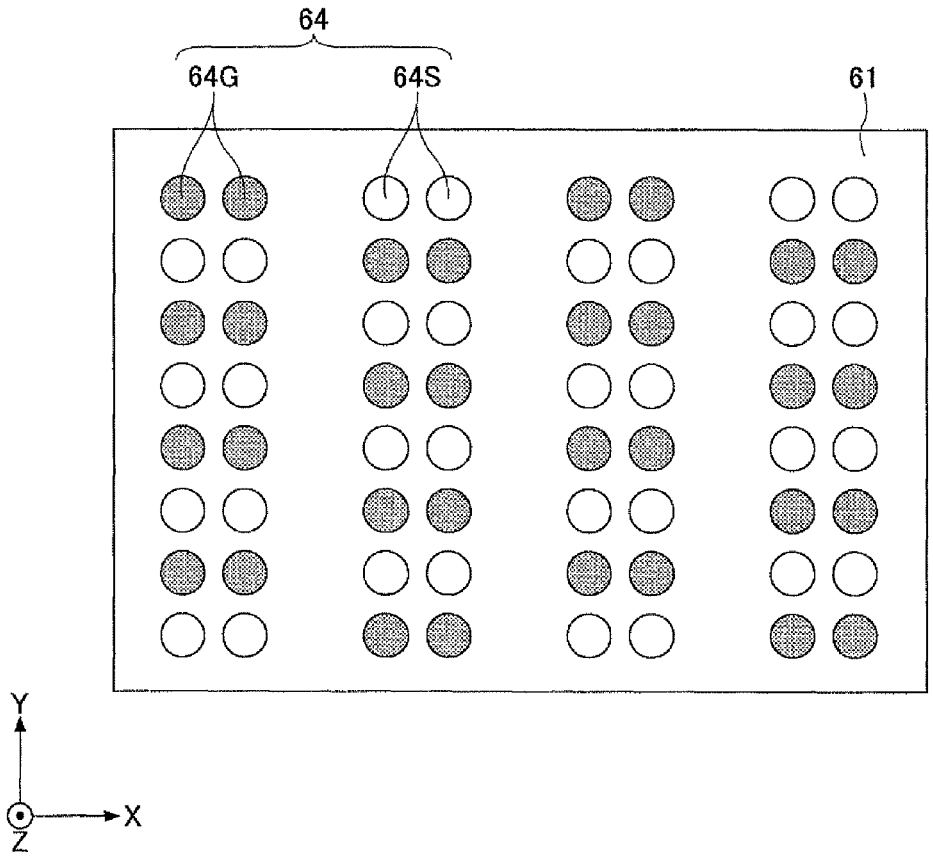
FIG. 7 is a bottom view illustrating another example of a pad arrangement of a semiconductor package according to the first embodiment of the present invention.

Alternatively, the pads 64 may be arranged as illustrated in FIG. 7. With reference to FIG. 7, two pads 64G, which are electrically connected to the reference potential (GND) of the semiconductor package 60, are arranged alongside each other (adjacently arranged pads 64G). Two pads 64S, which are used for transmitting differential end signals, are arranged alongside each other (adjacently arranged pads 64S). The reasons for arranging two pads 64S alongside each other are for increasing the coupling of signals transmitted from each pad 64S and for canceling each other's noise components. The pads 64G being arranged alongside each other and the pads 64S being arranged alongside each other are alternately arranged. For the sake of convenience, the pads 64G are illustrated with a matte surface in FIG. 7. Although all of the pads illustrated in FIG. 7 are either the pad 64G or the 64S, other pads for performing operations of the semiconductor package 60 may also be arranged in a part(s) of the wiring pattern of the semiconductor package 60 such as pads to be electrically connected to a power line of the semiconductor package 60.

Although not all of the pads 64*s* of the wiring pattern of the semiconductor package 60 are arranged for transmitting electric signals of the semiconductor package 60, the above-described arrangement of wiring pads are, in many cases, used for satisfactorily transmitting high frequency signals.

For example, copper (Cu) may be used as the material of the pad 64. The thickness of the pad 64 is, for example, approximately 5 μm to 10 μm. The semiconductor chip 62 is mounted on the substrate 61 by, for example, flip-chip bonding. The semiconductor chip 62 may be sealed with a sealing resin 63 formed of an insulating resin. Alternatively, the sealing resin 63 provided on the semiconductor chip 62 may expose a rear surface of the semiconductor chip 62, so that a heat release plate formed of, for example, copper (Cu) can be placed on the rear surface of the semiconductor chip 62.

Further, one or more metal layers may be formed on a top surface of the pad 64 for improving connection reliability between the connection terminal 30. The metal layer formed on the pad 64 may include a layer including a precious metal such as gold (Au) or palladium (Pd). The metal layer may be formed on the pad 64 by using, for example, an electroless plating method. Further, in a case where the metal layer formed on the pad 64 includes a gold (Au) layer, the metal layer may be a nickel/gold (Ni/Au) layer (i.e. metal layer including a Ni layer and a Au layer layered in this order), or a nickel/palladium/gold (Ni/Pd/Au) layer (i.e. metal layer including a Ni layer, a Pd layer, and a Au layer layered in this order). The thickness of the metal layer may be, for example, 0.4 μm.

The mounting substrate (e.g., motherboard) 70 includes a substrate body 71 and a conductive layer (pads) 72. The conductive layer 72 is formed on one surface of the substrate body 71. The substrate body 71 may be formed by, for example, impregnating a glass cloth with an insulating resin (e.g., epoxy type resin). For example, copper (Cu) may be used as the material of the conductive layer 72.

The housing 80 includes a frame part 81 and a lid part 82. The frame part 81 has a frame-like shape from a plan view. The frame part 81 is positioned further outside relative to an outer side surface of the positioning part 40. It is preferable to use, for example, a metal or a resin having a rigid property as the material of the frame part 81. The frame part 81 is fixed to the top surface of the mounting substrate 70 with, for example, a bolt (not illustrated) penetrating the mounting substrate 70.

The lid part 82 has a substantially rectangular shape or a substantially frame-like shape from a plan view. The lid part 82 is formed of, for example, a metal material or a resin material. For example, the lid part 82 has one end rotatably attached to a top surface of the frame part 81 and another end including a locking mechanism. By fixing (locking) the lid part 82 and the frame part 81 in a position in which an outer rim part of the lid part 82 contacts the top surface of the frame part 81 (as illustrated in, for example, FIGS. 3 and 4), the lid part 82 presses the semiconductor package 60 in a direction toward the mounting substrate 70. Thereby, the semiconductor package 60 is moved toward the mounting substrate 70.

Thereby, the connection terminals 30 of the socket 10 become compressed and contract in the Z direction. By compressing the connection terminals 30, a predetermined amount of resilient force is generated. Accordingly, adjacent pads 64 of the semiconductor package 60 contact the first and the second connection parts 31*b*, 33*b* of corresponding connection terminals 30. In other words, the semiconductor package 60 is electrically connected to the mounting substrate 70 by way of the socket 10. However, by releasing the lock of the locking mechanism of the lid part 82, the semiconductor package 60 can be detached from the socket 10.

It is to be noted that the lid part 82 and the frame part 81 may be separate components. In the case where the lid part 82 and the frame part 81 are separate components, the lid part 82 is to have a structure that can be fixed to the frame part 81, for example, when applying pressure from the lid part 82 to the semiconductor package 60 below the lid part 82.

Figure 8:
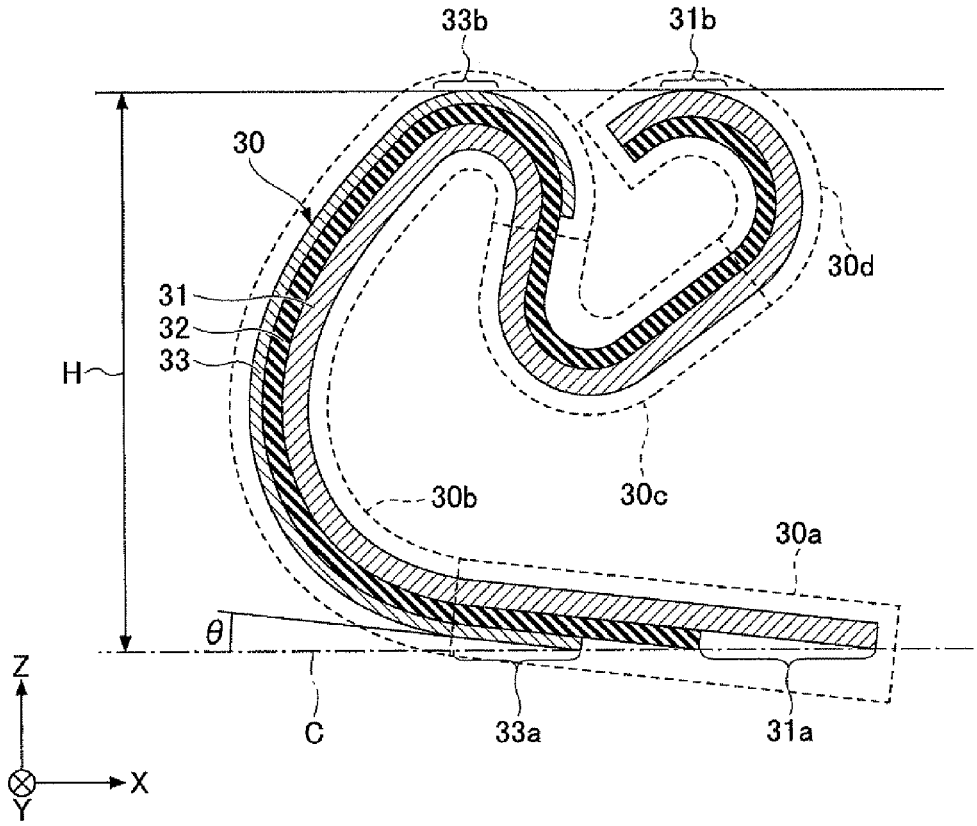
FIG. 8 is a cross-sectional view of a connection terminal according to the first embodiment of the present invention.

Next, a structure of the connection terminal 30 according to the first embodiment of the present invention is described with reference to FIG. 8. FIG. 8 is a cross-sectional view of the connection terminal 30 according to the first embodiment of the present invention. With reference to FIG. 8, the connection terminal 30 has an insulating layer 32 layered on a predetermined part of a metal plate 31. The connection terminal 30, having the insulating layer 32 layered on the predetermined part of the metal plate 31, is bent into a predetermined shape having a resilient property.

The metal plate 31, which is molded (bent) into a predetermined shape, is a narrow belt-like metal material that can be elastically deformed. For example, a 42 alloy (i.e. alloy of iron and nickel) or a copper alloy (e.g., phosphor bronze, beryllium copper, Corson alloy) may be used as the material of the metal plate 31. A plating film may be formed on the surface of the metal plate 31. For example, a nickel (Ni) plating film is formed on the surface of the metal plate 31. Further, a gold (Au) plating film may be layered on the nickel (Ni) plating film. The thickness of the metal plate 31 may be, for example, approximately 50 μm to 100 μm. The width of the metal plate 31 may be, for example, approximately 0.3 mm to 0.5 mm.

The insulating layer 32 is layered on a predetermined part of the metal plate 31. For example, the insulating layer 32 may be formed on a first surface of the metal plate 31 except for a part corresponding to the first fixing part 31*a*. As described below, because a conductive layer 33 is not formed on a part corresponding to the below-described connection part 30*c* or a part corresponding to the below-described second bent part 30*d*, the insulating layer 32 does not necessarily have to be formed at these parts. For example, an insulating resin such as an epoxy type resin or a polyimide type resin may be used as the material of the insulating layer 32. The thickness of the insulating layer 32 may be, for example, approximately 20 μm to 30 μm.

The conductive layer 33 is layered on a predetermined part of the insulating layer 32. For example, the conductive layer 33 is formed continuously on the insulating layer 32, so that the conductive layer 33 includes the below-described second fixing part 33*a* and the below-described second connection part 33*b*. It is preferable to not form the conductive layer 33 on an end part of the insulating layer 32 toward the first fixing part 31*a*. This is for avoiding short-circuiting between the metal plate 31 and the conductive layer 33 when bonding the first conductive layer (pads) 22 of the substrate 20 to the connection terminal 30 interposed by the first and the second fixing parts 31*a*, 33*a*. For example, a conductive material such as copper (Cu) may be used as the material of the conductive layer 33. The thickness of the conductive layer 33, may be, for example, approximately 3 μm to 30 μm.

The connection terminal 30 includes a fixing end part 30*a*, a first bent part 30*b*, a connection part 30*c*, and a second bent part 30*d*. Although the fixing end part 30*a*, the first bent part 30*b*, the connection part 30*c*, and the second bent part 30*d* are integrally formed, the connection terminal 30 is divided into the fixing end part 30*a*, the first bent part 30*b*, the connection part 30*c*, and the second bent part 30*d* for the sake of convenience.

The fixing end part 30*a* is formed on one end part of the connection terminal 30 and has a substantially straight shape. The fixing end part 30*a* includes the first fixing part 31*a* which is a part of the metal plate 31 (i.e. first exposed part of the metal plate 31 exposed from the insulating layer 32) and the second fixing part 33*a* which is a part of the conductive layer 33 formed on the metal plate 31 interposed by the insulating layer 32. The first fixing part 31*a* is a part that is bonded to one of the adjacent first conductive layers (pads) 22 of the substrate 20 interposed by bonding parts 51. The second fixing part 33*a* is a part that is bonded to the other one of the adjacent first conductive layers (pads) 22 of the substrate 20 interposed by the bonding parts 51. The first and the second fixing parts 31*a*, 33*a* can be formed having a substantially flat shape. The pitch between the first and the second fixing parts 31*a*, 33*a* is matched with the pitch of the adjacent first conductive layers (pads) 22 of the substrate 20. The pitch between the first and the second fixing parts 31*a*, 33*a* may be, for example, approximately 1.2 mm to 2.0 mm.

The first and the second fixing parts 31*a*, 33*a* are formed in correspondence with the interval of the adjacent first conductive layers (pads) 22 of the substrate 20. In FIG. 8, a plane C indicates a plane that is parallel to the first main surface 21*a* of the substrate 20. The first and the second fixing parts 31*a*, 33*a* may be inclined at a predetermined angle θ with respect to the plane C (first main surface 21*a* of the substrate 20) from a cross-sectional view. In the inclined state, the first and the second fixing parts 31*a*, 33*a* may be bonded to the first conductive layer (pads) 22 interposed by the bonding part 51. The predetermined angle θ may be, for example, approximately 0 degrees to 0.1 degrees.

Accordingly, by having the first and the second fixing parts 31*a*, 33*a* inclined at the predetermined angle θ with respect to the first main surface 21*a* of the substrate 20, the substrate 20 and the first bent part 30*b* can be prevented from contacting each other by the below-described deformation of the first bent part 30*b* when pressure from, for example, the semiconductor package 60 is applied to the first and the second connection parts 31*b*, 33*b*. Thereby, the connection terminal 30 and the substrate 20 can be prevented from being damaged.

The first bent part 30*b* is a part of the connection terminal 30 that is adjacent to the fixing end part 30*a*. The first bent part 30*b* is bent into a predetermined shape. The first bent part 30*b* includes the second connection part 33*b* which is a part of the conductive layer 33 layered on the metal plate 31 interposed by the insulating layer 32. The second connection part 33*b* is bent, so that the second connection part 33*b* projects in a direction opposite of the first and the second fixing parts 31*a*, 33*a* (direction separating from the first and the second fixing parts 31*a*, 33*a*). The second connection part 33*b* is a part that contacts one of the adjacent pads of the first connection object (e.g., conductive layer 64 of the semiconductor package 60). The second connection part 33*b* is electrically connected to the second fixing part 33*a*.

The first bent part 30*b* is bent into a shape of, for example, the letter C. The first bent part 30*b* has a resilient property. The function of the first bent part 30*b* is described below. The connection part 30*c* is a part that connects the first and the second bent parts 30*b*, 30*d*. The connection part 30*c* is bent, so that the connection part 30*c* projects from the side of the first and the second connection parts 31*b*, 33*b* to the side of the first and the second fixing parts 31*a*, 33*a*.

The second bent part 30*d* is a part of the connection terminal 30 that is adjacent to the connection part 30*c*. The second bent part 30*d* is bent into a predetermined shape. The second bent part 30*d* includes the first connection part 31*b* which is a part of the metal plate 31 having a rear surface on which the insulating layer 32 is formed. The first connection part 31*b* is bent, so that the first connection part 31*b* projects in a direction opposite of the first and the second fixing parts 31*a*, 33*a* (direction separating from the first and the second fixing parts 31*a*, 33*a*). The first connection part 31*b* is a part that contacts the other one of the adjacent pads 64 of the first connection object (e.g., the conductive layer of the semiconductor package 60). The first connection part 31*b* is a part of a second surface of the metal plate 31 that does not have the insulating layer 32 formed thereon (i.e. second exposed part of the metal plate 31 exposed from the insulating layer 32). The first connection part 31*b* is electrically connected to the first fixing part 31*a*.

The first and the second connection parts 31*b*, 33*b* are formed in correspondence with the interval of the adjacent pads of the first connection object (e.g., the conductive layer 64 of the semiconductor package 60). Further, the first fixing part 31*a* and the first connection part 31*b* are formed facing outward and arranged opposite from each other. The second fixing part 33*a* and the second connection part 33*b* are formed facing outward and arranged opposite from each other. The pitch between the first and the second connection parts 31*b*, 33*b* is matched with the pitch between the conductive layers (pads) 64. For example, the pitch between the first and the second connection parts 31*b*, 33*b* may be, for example, approximately 0.4 mm to 1.5 mm. Accordingly, pitch conversion of the connection terminals 30 can be achieved. For example, the narrow pitch of the conductive layers (pads) 64 (e.g., approximately 0.4 mm to 1.5 mm) can be converted to the pitch of the first conductive layers (pads) 22 (e.g., approximately 1.2 mm to 2.0 mm).

The first bent part 30*b* causes the first and the second connection parts 31*b*, 33*b* to exert a resilient force against, for example, the conductive layer 64 when pressure is applied from, for example, the semiconductor package 60 to the first and the second connection parts 31*b*, 33*b*. Thus, the first bent part 30*b* has a function of causing the first and the second connection parts 31*b*, 33*b* to contact, for example, the conductive layer 64 without having to fix the first and the second connection parts 31*b*, 33*b* to, for example, the conductive layer 64. However, technically, with the connection terminal 30 according to this embodiment, a part of the connection terminal 30 excluding the fixing end part 30*a* functions as a spring as a whole. The spring constant of the part of the connection terminal 30 excluding the fixing end part 30 may be, for example, 0.6 N/mm to 0.8 N/mm.

In a state where the first and the second connection parts 31*b*, 33*b* are moved in a direction toward the fixing end parts 30*a* (Z direction) owing to the deforming (bending) of the first bent part 30*b* caused by the pressure applied to the first and the second connection parts 31*b*, 33*b*, the first and the second connection parts 31*b*, 33*b* contact the adjacent conductive layers 64 or the like. Accordingly, the first and the second connection parts 31*b*, 33*b* can be prevented from moving a significant amount in a direction parallel to a surface on which adjacent conductive layers 64 or the like are formed when the first and the second connection parts 31*b*, 33*b* contact the adjacent conductive layers 64 or the like. Therefore, the conductive layers 64 or the like can be arranged with a narrow pitch. The pitch of the conductive layers 64 or the like may be, for example, approximately 0.4 mm to 1.5 mm.

In the state illustrated in FIG. 8 (a state where no pressure is applied to the first and the second connection parts 31*b*, 33*b* of the connection terminal 30), the height H of the connection terminal 30 may be, for example, approximately 1 mm to 2 mm.

For example, in a case where the connection terminal 30 contacts the pads 64 illustrated in FIG. 6, one of the first and the second connection parts 31*b*, 33*b* contacts the pad 64G whereas the other one of the first and the second connection parts 31*b*, 33*b* contacts the pad 64S. Accordingly, in a case of transmitting single end signals from a single connection terminal 30 according to this embodiment, the signals can be shielded (blocked) at the GND. Thereby, the connection terminal 30 can be prevented from being adversely affected by, for example, cross-talk noise. Further, characteristic impedance using the microstrip line structure can be matched. Thus, transmission characteristics of single end signals can be improved to a high frequency bandwidth.

For example, in a case where the connection terminal 30 contacts the pads 64 illustrated in FIG. 7, the first and the second connection parts 31*b*, 33*b* of the connection terminal 30 located in a predetermined position contact the adjacently arranged pads 64G. Further, the first and the second connection parts 31*b*, 33*b* of the connection terminal 30 located next to the connection terminal 30 of the predetermined position contact the adjacently arranged pads 64S located next to the adjacently arranged pads 64G. One of the first and the second connection parts 31*b*, 33*b* contacting the adjacently arranged pads 64S transmits one of the signals constituting a differential signal whereas the other one of the first and the second connection parts 31*b*, 33*b* contacting the adjacently arranged pads 64S transmits another one of the signals constituting the differential signals. Thus, in a case of transmitting differential end signals with a single connection terminal 30, the interval between one of the differential signals and the other one of the differential signals can be minimized. Thereby, the radiation noise of one of the differential signals and the radiation noise of the other one of the differential signals (noise) can be cancelled. Thus, transmission characteristics of differential signals can be improved to a high frequency bandwidth.

In this embodiment, the first and the second fixing parts 31*a*, 33*a* formed on one end of the connection terminal 30 are indirectly electrically and mechanically connected to the adjacent conductive layers (pads) 72 of the mounting substrate (second connection object) 70 by way of the substrate 20. Alternatively, the first and the second fixing parts 31*a*, 33*a* may be directly electrically and mechanically connected to the adjacent conductive layers (pads) 72 of the mounting substrate (second connection object) 70 without the substrate 20 interposed therebetween. In the case where the substrate 20 is not interposed between the first and the second fixing parts 31*a*, 33*a* and the adjacent conductive layers (pads) 72 of the mounting substrate (second connection object) 70, the positioning part 40 may be provided on the mounting substrate 70, and the first and the second fixing parts 31*a*, 33*a* formed on one end of the connection terminal 30 are electrically and mechanically connected to the adjacent conductive layers (pads) 72 of the mounting substrate 70 interposed by the bonding part 51.

[Method for Manufacturing Socket According to First Embodiment]

Next, a method for manufacturing the socket 10 according to the first embodiment of the present invention is described with reference to FIGS. 9-20. First, a method for manufacturing the connection terminal 30 is described with reference to FIGS. 9-17. It is to be noted that FIGS. 9A, 10A, 11A, 12A, 13A, and 14A are plan views, and FIGS. 9B, 10B, 11B, 12B, 13B, and 148 are cross-sectional views. Further, FIGS. 15-20 are cross-sectional views. For the sake of convenience, the plan views 9A, 10A, 11A, 12A, 13A, and 14A are illustrated with the same hatchings as those of the cross-sectional views 9B, 108, 11B, 12B, 13B, and 148.

Figure 9A:
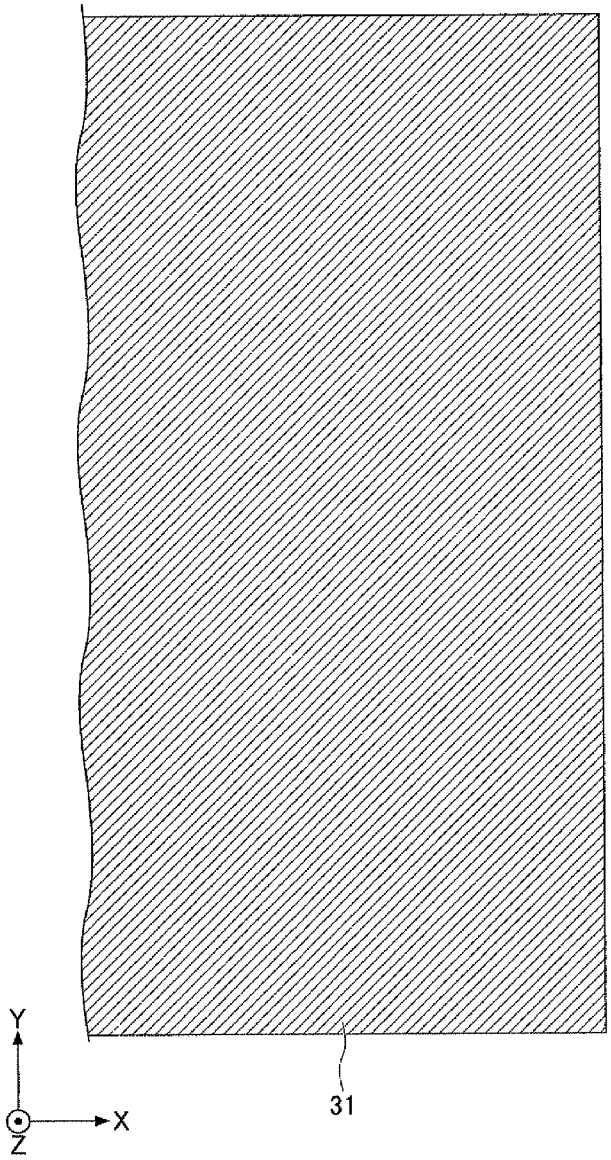
FIGS. 9A-20 are schematic diagrams for describing a method for manufacturing a socket according to the first embodiment of the present invention.
Figure 9B:
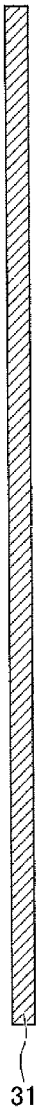

First, in a process illustrated in FIGS. 9A and 9B, a hoop-shaped metal plate 31 is prepared. A first surface of the metal plate 31 is roughened. For example, a 42 alloy (i.e. alloy of iron and nickel) or a copper alloy (e.g., phosphor bronze, beryllium copper, Corson alloy) may be used as the material of the metal plate 31. The thickness of the metal plate 31 may be, for example, approximately 50 μm to 100 μm. The roughening of the first surface of the metal plate 31 may be performed by, for example, an etching process or a blasting process.

Figure 10A:
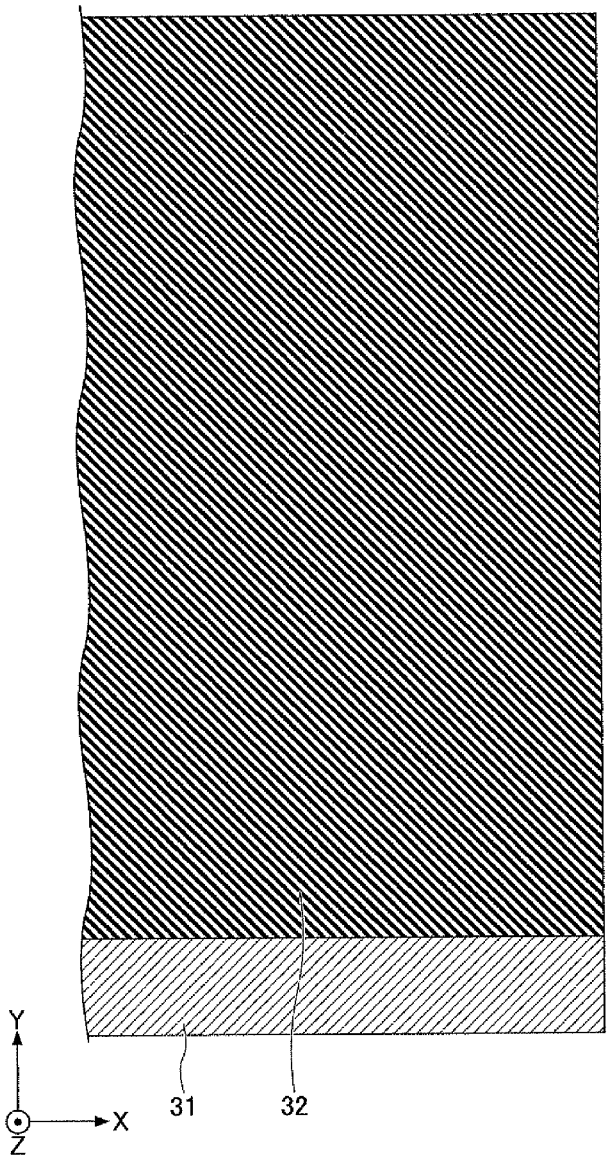
Figure 10B:
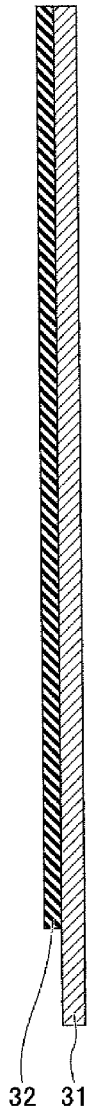

Then, in the process illustrated in FIGS. 10A and 10B, the insulating layer 32 is formed on the first surface of the metal plate 31. The insulating layer 32 exposes a part of the metal plate 31 which eventually becomes the first fixing part 31*a* of the connection terminal 30 and covers the remaining parts of the metal plate 31. The insulating layer 32 may be formed by, for example, laminating an insulating resin sheet on a part of the metal plate 31 excluding the part of the metal plate 31 which eventually becomes the first fixing part 31*a* of the connection terminal 30. Alternatively, the insulating layer 32 may be formed by applying an insulating resin paste or an insulating resin liquid to the first surface of the metal plate 31 after masking the part of the metal plate 31 which eventually becomes the first fixing part 31*a* of the connection terminal 30. The insulating layer 32 may be formed by using, for example, an epoxy type insulating resin having a thermal setting property. In a case of the epoxy type insulating resin having a thermal setting property is used, the insulating layer 32 is formed by laminating an insulating resin on a first surface of the metal plate 31 and curing the insulating resin at a predetermined temperature. The thickness of the insulating layer 32 is, for example, approximately 20 μm to 30 μm.

Figure 11A:
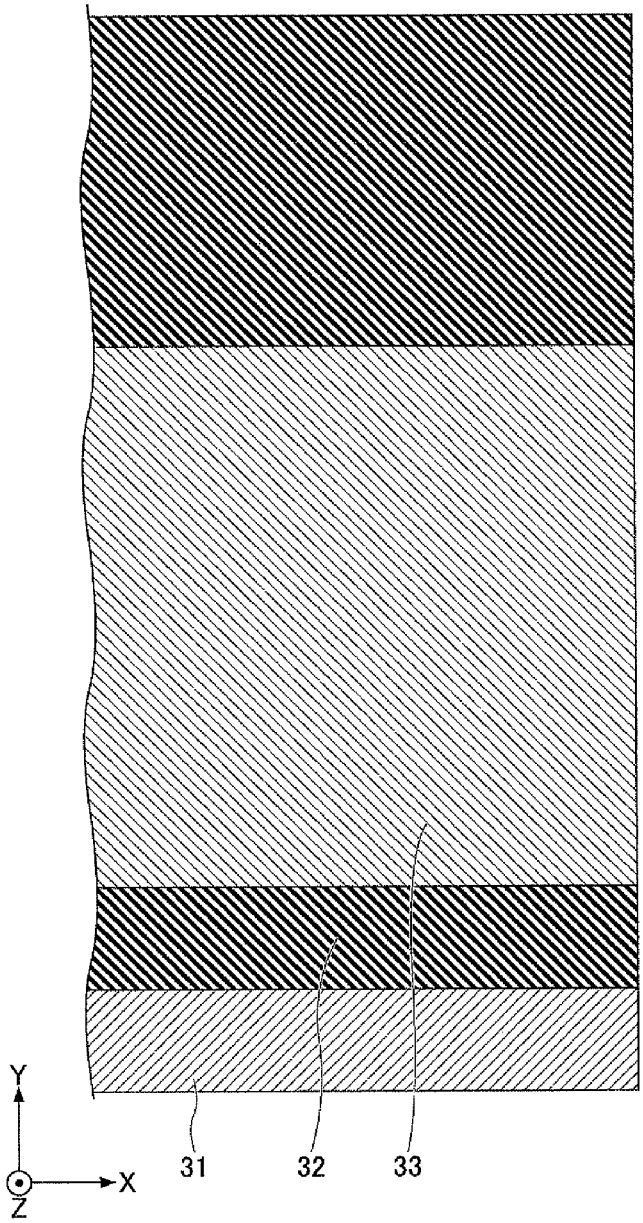
Figure 11B:
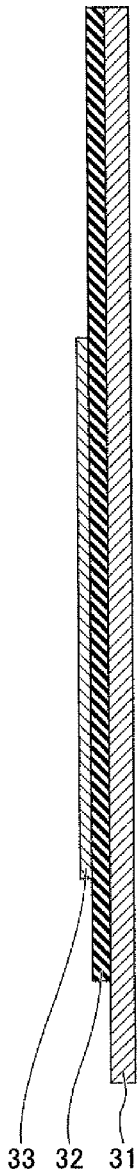

Then, in the process illustrated in FIGS. 11A and 11B, the conductive layer 33 is formed on the insulating layer 32 of the first surface of the metal plate 31. The conductive layer 33 is formed continuously, so that a part which eventually becomes the second fixing part 33*a* of the connection terminal 30 and a part which eventually becomes the second connection part 33*b* of the connection terminal 30 are included in the conductive layer 33. For example, a mask (e.g., resist layer), which exposes a part of the insulating layer 32 on which the conductive layer 33 is to be formed, is formed on the insulating layer 32. Then, an electroless plating process is performed on the part of the insulating layer 32 exposed by the mask. Thereby, the conductive layer 33 is formed on the insulating layer 32. Alternatively, for example, a metal layer may be formed on the part of the insulating layer 32 exposed by the mask with an electroless plating process. Then, electroplating is performed on the insulating layer 32 by using the metal layer as a feed layer. Thereby, the conductive layer 33 is formed on the insulating layer 32. For example, a conductive material such as copper (Cu) may be used as the material of the conductive layer 33. The thickness of the conductive layer 33 may be, for example, approximately 3 μm to 30 μm.

Figure 12A:
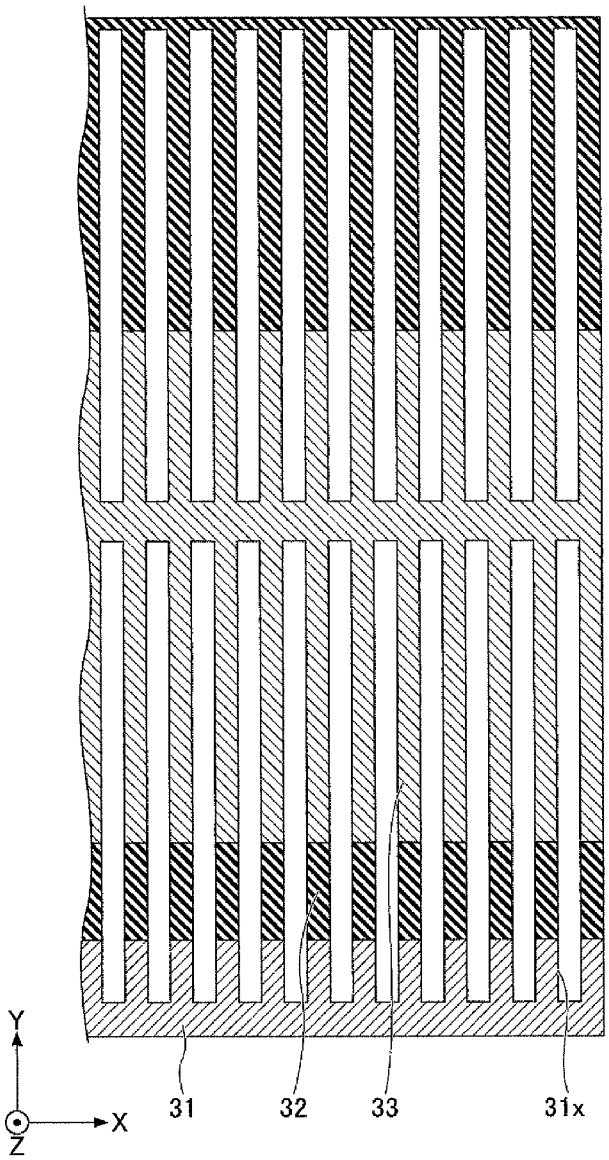
Figure 12B:
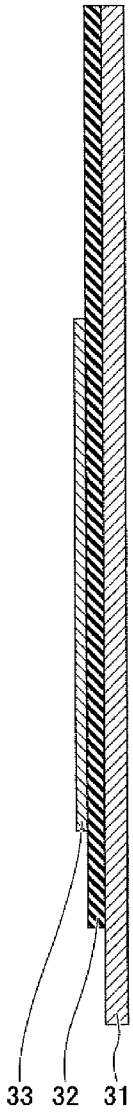

Then, in the process illustrated in FIGS. 12A and 12B, slits 31*x* are formed in the configuration illustrated in FIGS. 11A and 11B. The slits 31*x* are holes that penetrate the configuration illustrated in FIGS. 11A and 11B. The slits 31*x* may be formed by, for example, stamping. The slits 31*x* include a pair(s) of slits 31*x* arranged at predetermined intervals in a vertical direction (Y direction). Further, the slits 31*x* are also arranged at predetermined intervals in a horizontal direction (X direction). The configuration illustrated in FIGS. 12A and 12B is eventually divided into separate pieces at the parts between adjacent pairs of slits 31*x* arranged in the horizontal direction (X direction), so that each piece becomes a single connection terminal 30.

The reason for forming the slits 31 in the process illustrated in FIGS. 12A and 12B is because a plating film is formed at a part which eventually becomes a side surface of the connection terminal 30 in a below-described process. The reason for arranging the slits 31*x* at a predetermined interval in the vertical direction (Y direction) is because of the difficulty in performing an electroplating process on the conductive layer 33 in a below-described process in a case where all of the adjacent slits 31*x* are combined without any interval provided between the slits 31*x*. That is, it would be difficult to feed power in such a case. In the processes illustrated in FIGS. 10A-12B, the characteristic impedance of the connection terminal 30 can be set to a desired value (e.g., 50Ω) by adjusting the thickness of the insulating layer 32, and the interval of the pairs of slits 31*x* arranged in horizontal direction (X direction). The interval of the pairs of slits 31 arranged in the horizontal direction eventually becomes the width of the conductive layer 33 of the connection terminal 30.

Figure 13A:
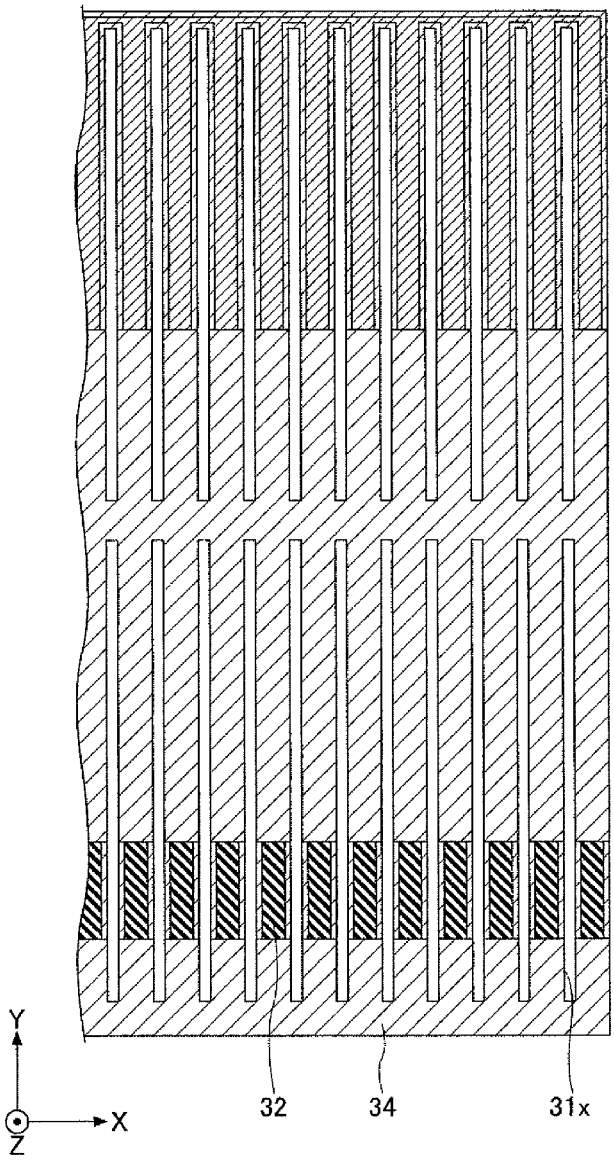
Figure 13B:
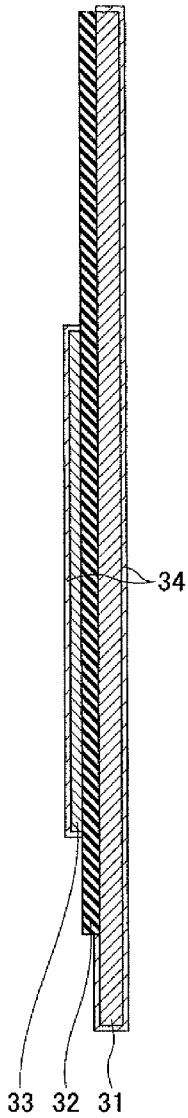

Then, in the process illustrated in FIGS. 13A and 13B, a plating film 34 is formed on a part of the configuration illustrated in FIGS. 12A and 12B at which the metal plate 31 does not contact the insulating layer 32 and a part of the configuration illustrated in FIGS. 12A and 12B at which the conductive layer 33 does not contact the insulating layer 32. The plating film 34 may be formed by, for example, an electroplating method where the metal plate 31 and the conductive layer 33 are used as feed layers. The plating film 34 may be, for example, a nickel (Ni) plating film. Alternatively, the plating film 34 may have a gold (Au) plating film (upper layer) layered on a nickel (Ni) plating film (lower upper). The thickness of the nickel (Ni) plating film may be, for example, approximately 1 μm to 3 μm. The thickness of the gold (Au) plating film may be, for example, approximately 0.3 μm to 0.5 μm. In a case of increasing the conductive layer 33, an electrolytic copper plating film may be formed on the part of the configuration illustrated in FIGS. 12A and 12B at which the metal plate 31 does not contact the insulating layer 32 and the part of the configuration illustrated in FIGS. 12A and 12B at which the conductive layer 33 does not contact the insulating layer 32 before forming the plating film 34.

Then, in the process illustrated in FIGS. 14A and 14B, slits 31*y* are formed by removing parts above and below (Y direction) the slits 31*x* except for a connection (coupling) part 35. The slits 31*y* may be formed by, for example, stamping. In the process illustrated in FIGS. 14A and 14B, plural thin belt-like structures, which are connected by the connection (coupling) part 35 on one end of the metal plate 31, are formed. The plural structures eventually become connection terminals 30.

Figure 14A:
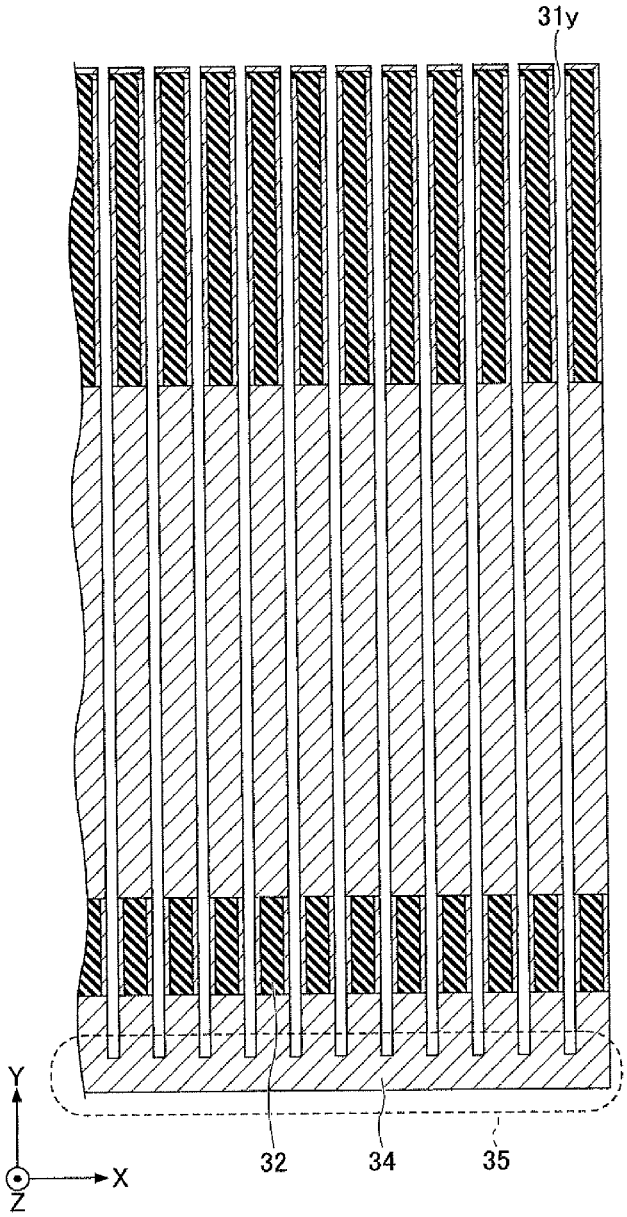
Figure 14B:
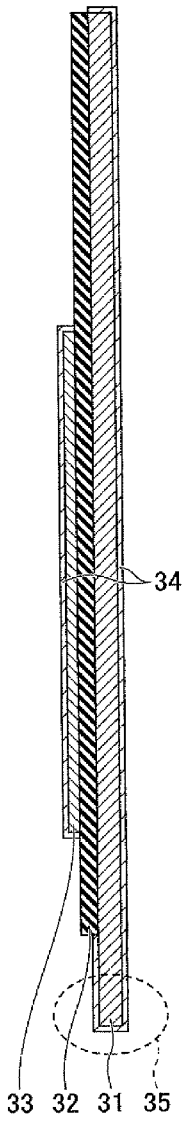
Figure 15:
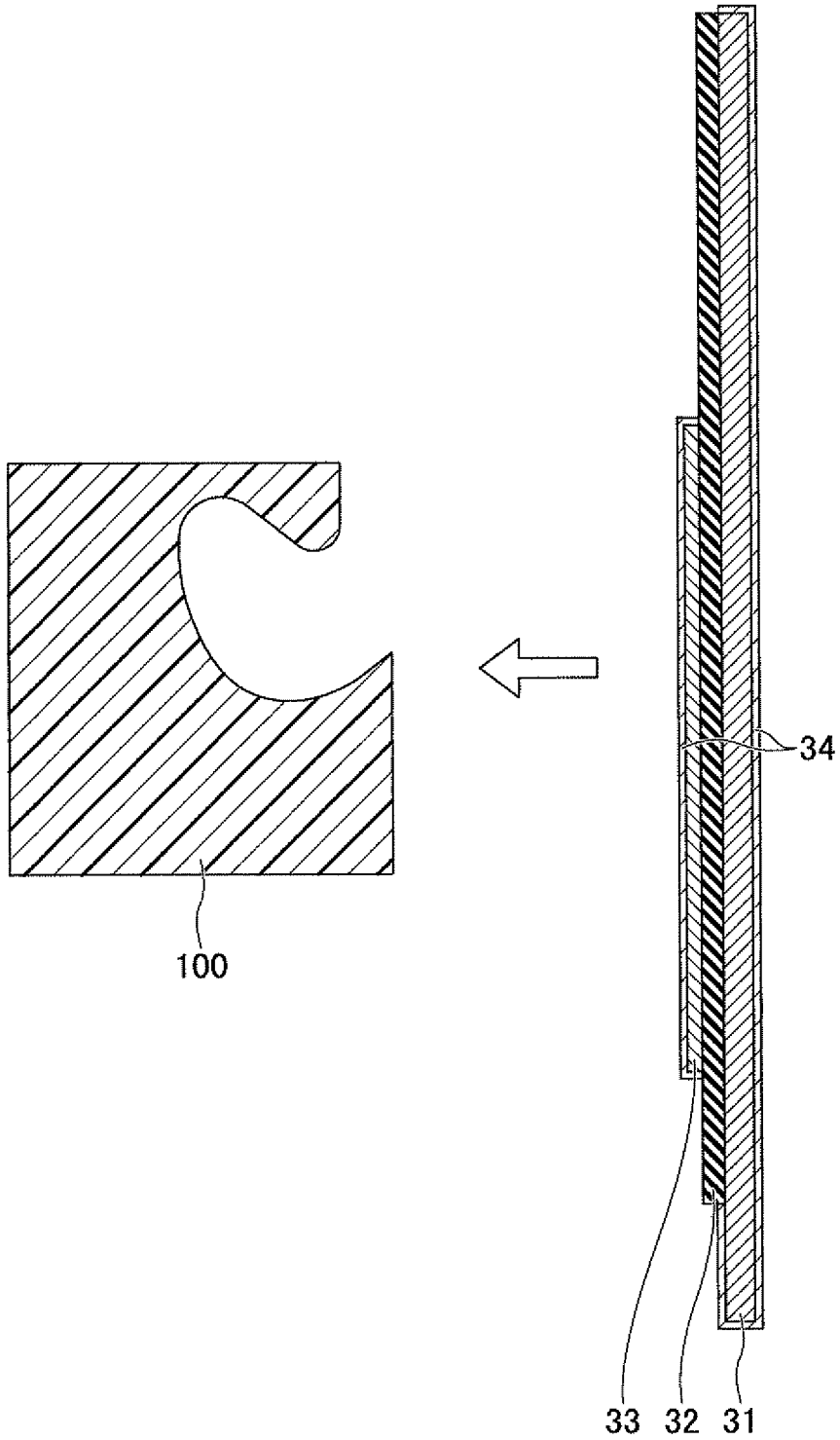
Figure 16:
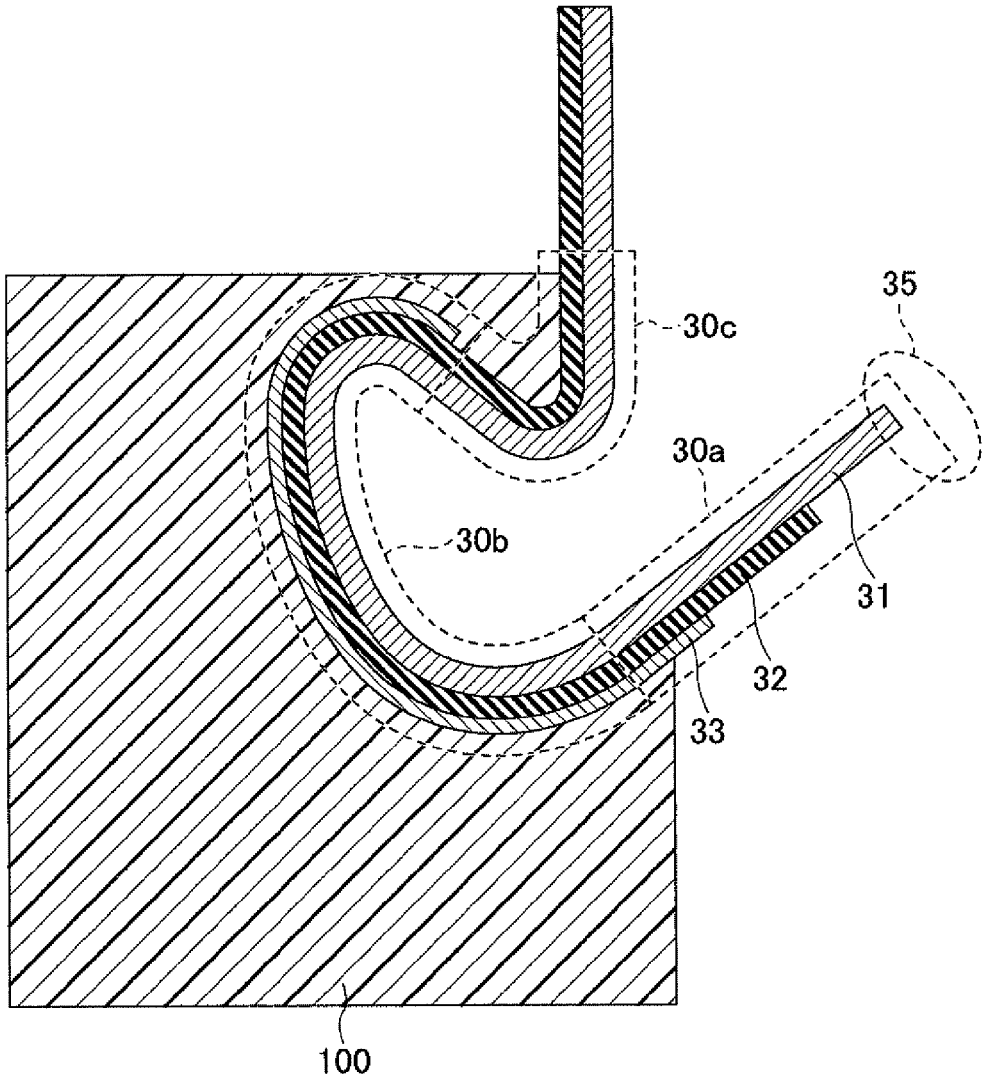
Figure 17:
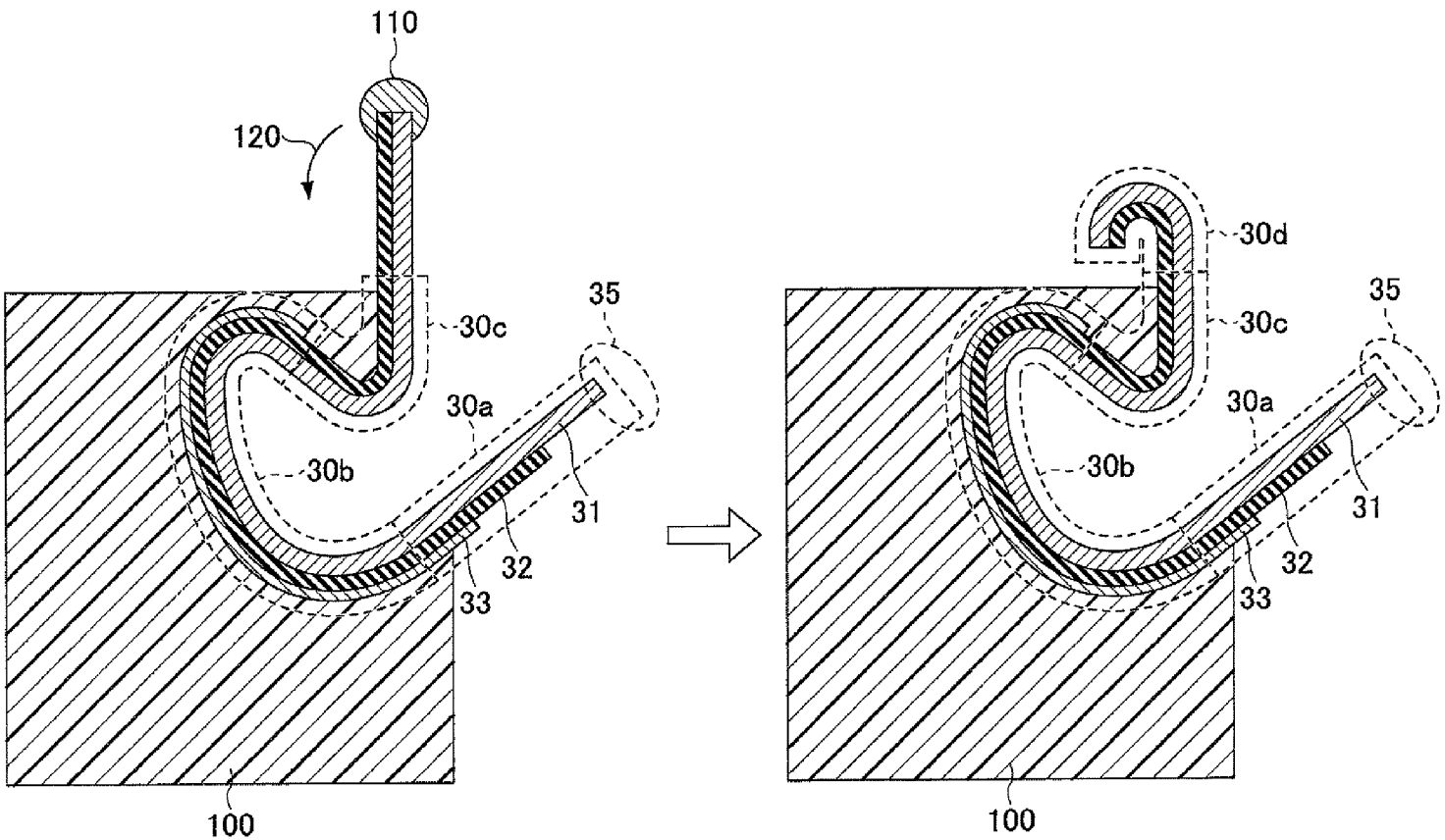

Then, in the processes illustrated in FIGS. 15-17, the plural narrow belt-like structures illustrated in FIGS. 14A and 14B are formed into predetermined shapes. For example, the plural narrow belt-like structures illustrated in FIGS. 14A and 14B are pressed into a bending jig 100 as illustrated in FIG. 15 and bent along an inner side surface of the bending jig 100 as illustrated in FIG. 16. Thereby, the fixing end part 30*a*, the first curve part 30*b*, and the connection part 30*c* illustrated in FIG. 8 are formed.

Then, in the process illustrated in FIG. 17, a tip curling jig 110 is prepared. The tip curling jig 110 is for curling a tip of the structure illustrated in FIG. 16. The tip curling jig 110 has a cylindrical shape including a groove formed along a longitudinal direction of the tip curling jig 110. One end of the connection part 35 of the structure illustrated in FIG. 16 is inserted into the groove of the tip curling jig 110. The tip curling jig 110 is turned in a direction illustrated with arrow 120. Thereby, the tip of the structure illustrated in FIG. 16 is bent. Thereby, the shape of the second bent part 30*d* illustrated in FIG. 8 can be formed. Then, plural narrow belt-like connection terminals 30 can be formed having predetermined shapes by cutting off the connection part 35 of the configuration illustrated in FIG. 17.

In light of productivity, the transition to the process illustrated in FIG. 17 may be performed after cutting off the connection part 35 beforehand in FIG. 16, so that a predetermined number of narrow belt-like structures connected by the connection part 35 can be obtained. The plating film 34 illustrated in, for example, FIGS. 13A and 13B. In FIGS. 8, 15-17, the plating film 34 is omitted.

Figure 18:
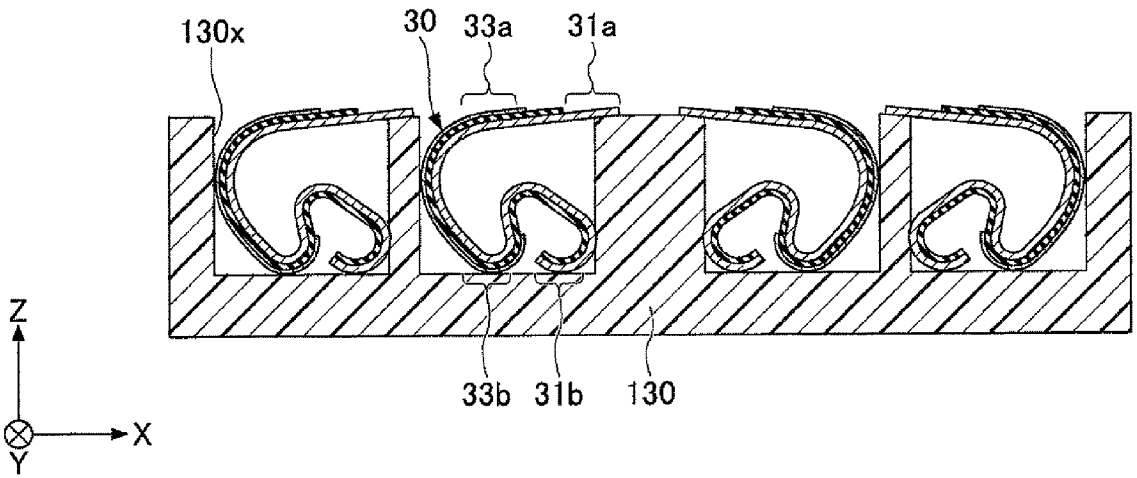
Figure 19:
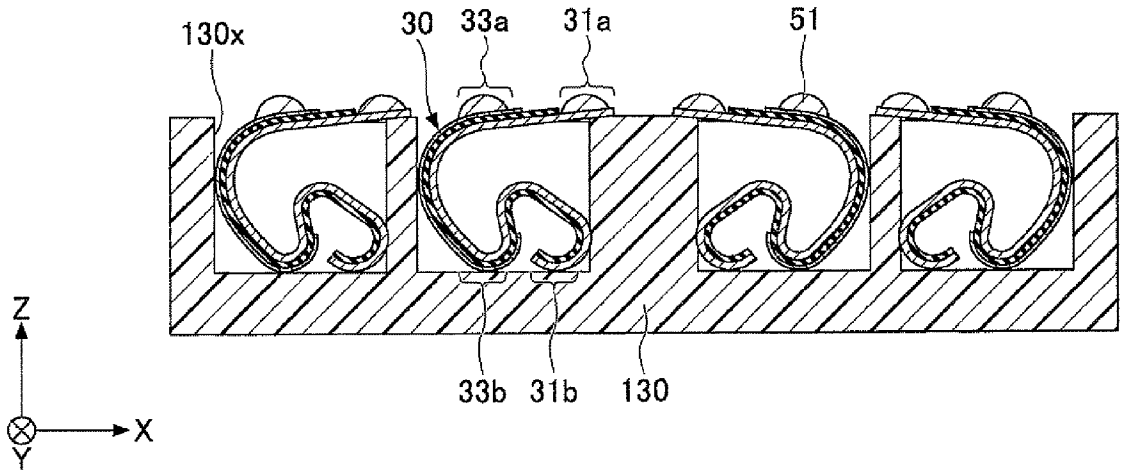
Figure 20:
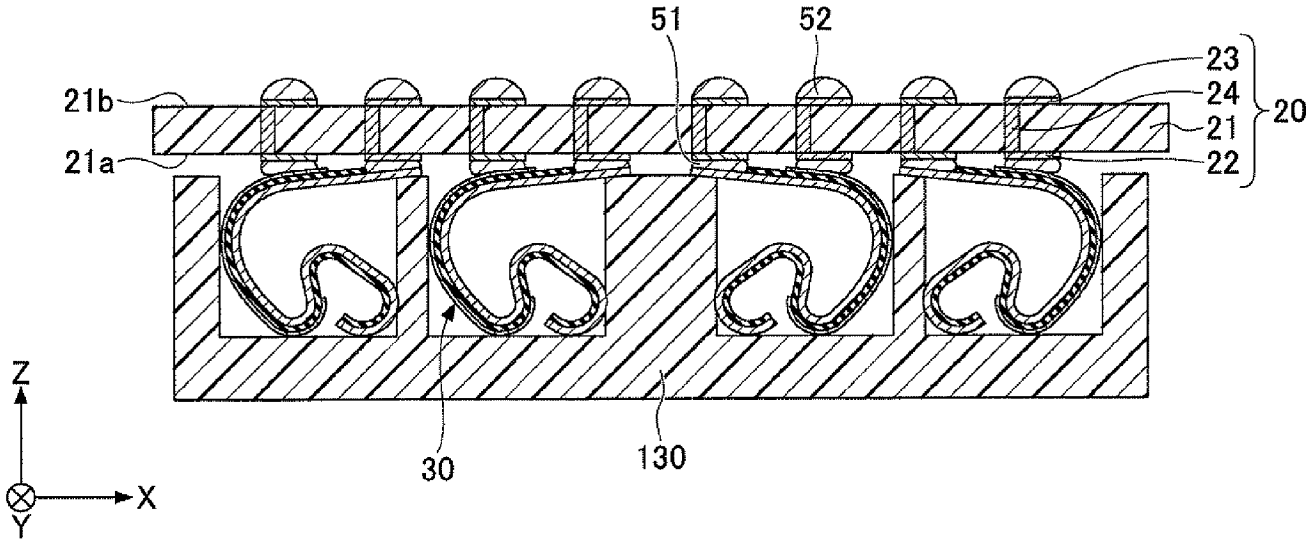

Next, a method of manufacturing the socket 10 using the connection terminals 30 according to an embodiment of the present invention is described with reference to FIGS. 18 to 20. FIGS. 18-20 are cross-sectional views. In FIGS. 18 to 20, components/parts such as the connection terminals 30 are illustrated in a vertically inverted (upside down) state relative to, for example, the components/parts is illustrated in FIG. 3.

First, in the process illustrated in FIG. 18, an arranging jig 130 including plural trenches 130*x* is prepared. The plural connection terminals 30 are inserted into corresponding trenches 130*x*. The connection terminals 30 are inserted into the corresponding trenches 130*x*, so that the first and the second connection parts 31*b*, 33*b* contact a bottom part of the trench 130*x*, and the first and the second fixing parts 31*a*, 33*a* are exposed from the trench 130*x*.

Then, in the process illustrated in FIG. 19, the bonding parts 51 are formed on corresponding first and second fixing parts 31*a*, 33*a*. For example, a conductive material such as solder or a conductive resin paste (e.g., silver (Ag) paste) may be used as the material of the bonding part 51. In a case where solder is used as the material of the bonding part 51, the solder may be, for example, an alloy including lead (Pb), an alloy including tin (Sn) and copper (Cu), an alloy including tin (Sn), silver (Ag), and copper (Cu), an alloy including tin (Sn) and antimony (Sb), an alloy including tin (Sn), silver (Ag), copper (Cu), and antimony (Sb), or an alloy including tin (Sn), silver (Ag), bismuth (Si), and indium (In).

The bonding parts 51 may be formed by, for example, applying solder paste or mounting solder balls on the first and the second fixing parts 31*a*, 33*a*.

Then, in the process illustrated in FIG. 20, the substrate 20 having bonding parts 52 formed on the second conductive layer 23 is prepared. The substrate 20 is positioned, so that the first conductive layers 22 of the substrate 20 contact corresponding bonding parts 51. Then, the substrate, 20, the connection terminals 30, the bonding parts 51, 52 and the jig 130 are placed in a reflow furnace, so that the bonding parts 51, 52 can be melted by heating the bonding parts 51, 52 in a temperature of, for example, 220° C.-250° C. Then, the bonding parts 51, 52 are cured by returning the temperature to normal temperature. Thereby, the substrate 20 and the connection terminals 30 are bonded interposed by the bonding parts 51.

Then, the jig 130 is removed. Then, the positioning part 40 is fixed to the outer rim part of the first main surface 21*a* of the substrate 20 by using, for example, an adhesive agent (not illustrated). The positioning part 40 is a member having, for example, an epoxy type resin as a main composition. The positioning part 40 has a frame-like shape from a plan view. Alternatively, the positioning part 40 may be mechanically attached to the substrate 20 with, for example, a screw. In a case of securing the position of the semiconductor package 60 by using the below-described frame part 81 of the housing 80 instead of the positioning part 40, the process of attaching the positioning part 40 may be omitted. By performing the processes illustrated in FIGS. 9A to 20, the manufacturing of the socket 10 including the connection terminals 30 (see, for example, FIG. 3) is completed.

Alternatively, the processes illustrated in FIGS. 19 and 20 may be performed as follows. First, the bonding parts 51 are formed beforehand on the first conductive layer 22 of the substrate 20 illustrated in FIG. 20. Then, the substrate having the bonding parts 51 formed on the first conductive layer 22 is positioned so that the bonding parts 51 contact the first and the second fixing parts 31*a*, 33*a* of the connection terminals 30 inserted into the arranging jig 130. Thereby, the state illustrated in FIG. 20 can be realized. Then, as described above, the substrate, 20, the connection terminals 30, the bonding parts 51, 52 and the jig 130 are placed in a reflow furnace, so that the bonding parts 51, 52 can be melted by heating the bonding parts 51, 52 in a temperature of, for example, 220° C.-250° C. Then, the bonding parts 51, 52 are cured by returning the temperature to normal temperature. Thereby, the substrate 20 and the connection terminals 30 are bonded interposed by the bonding parts 51.

[Method for Using Socket According to First Embodiment]

Next, a method for connecting the semiconductor package 60 and the mounting substrate 70 by using the socket 10 according to an embodiment of the present invention is described with reference to FIGS. 21 and 22.

Figure 21:
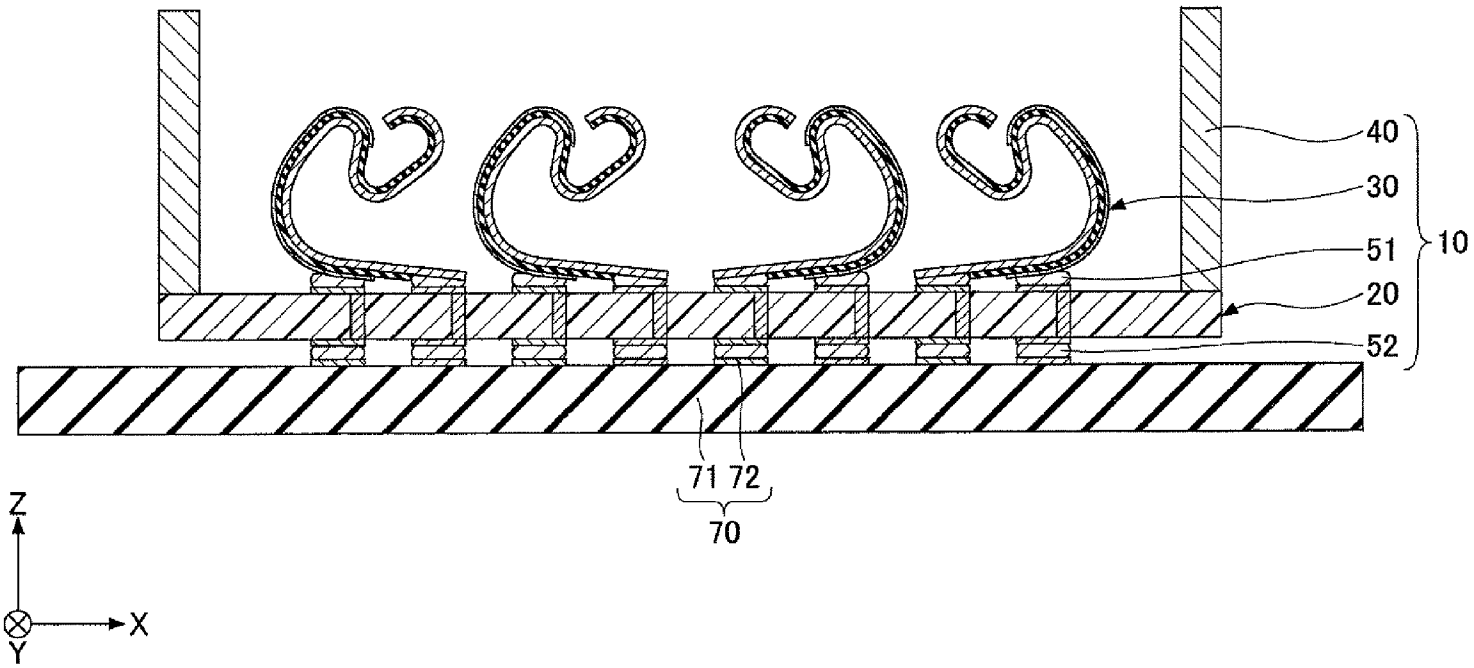
FIGS. 21 and 22 are schematic diagrams for describing a method for connecting a socket according to the first embodiment of the present invention.

First, as illustrated in FIG. 21, the mounting substrate 70 and the socket 10 are prepared. Then, the mounting substrate 70 and the socket 10 are bonded interposed by the bonding parts 52. Thereby, the mounting substrate 70 and the socket 10 are electrically and mechanically connected. For example, the conductive layer 72 of the mounting substrate 70 and the bonding parts 52 of the socket 10 are positioned contacting each other. Then, the bonding parts 52 are melted by heating the bonding parts 52 in a temperature of, for example, 230° C. Then, the bonding parts 52 are cured. Thereby, the mounting substrate 70 and the socket 10 are bonded interposed by the bonding parts 52. Accordingly, the socket 10 is electrically and mechanically connected to the mounting substrate 70 interposed by the bonding parts 52.

Figure 22:
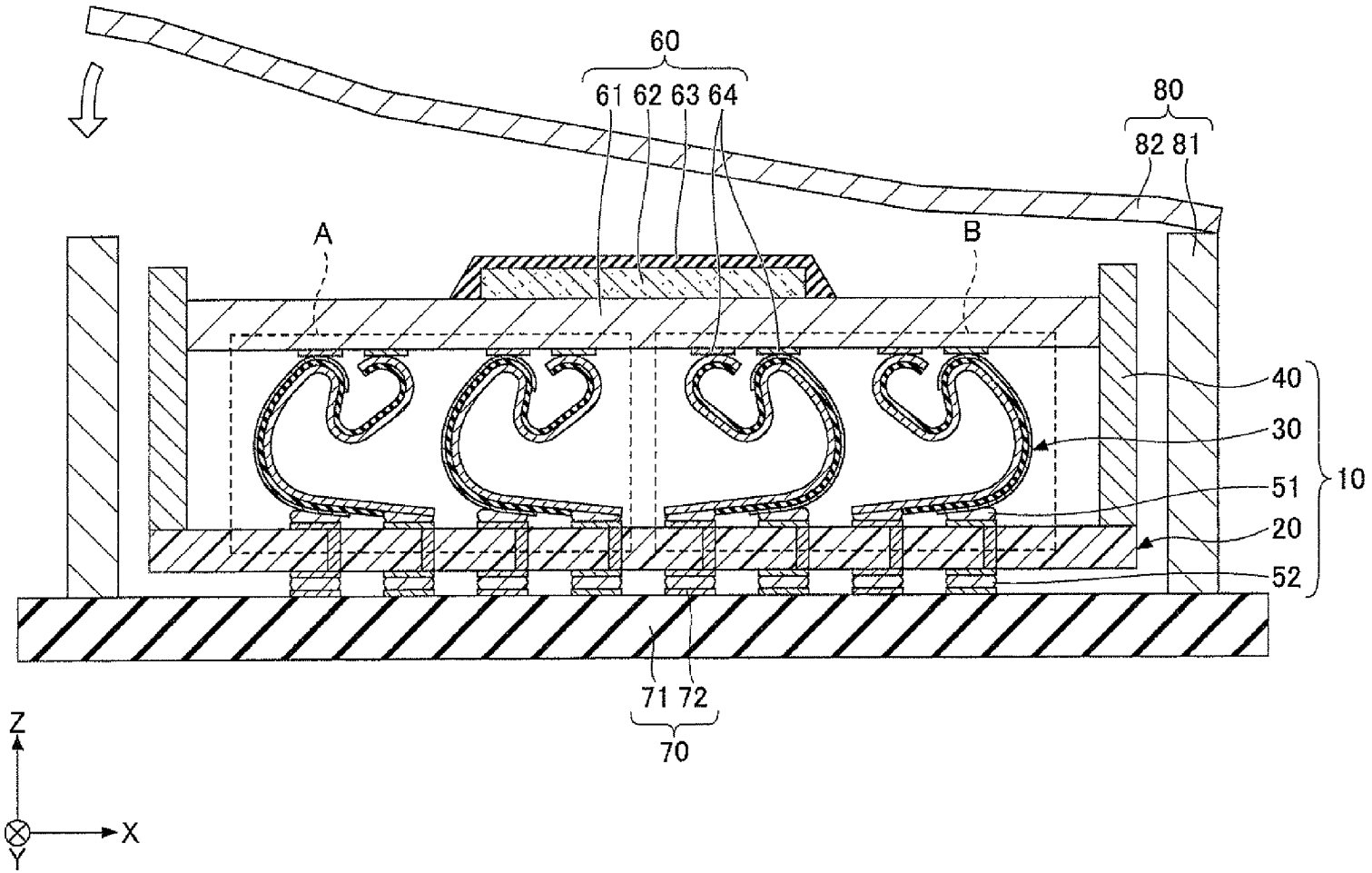

Then, as illustrated in FIG. 22, the housing 80 is prepared and has its frame part 81 fixed to a top surface of the mounting substrate 70 by using, for example, a bolt (not illustrated) penetrating the mounting substrate 70. Then, the lid part 82 of the housing 80 is opened, and the semiconductor package 60 is inserted in the positioning part 40, so that the side surface of the substrate 61 contacts the inner side surface of the positioning part 40. At this point, however, no pressure is applied to the connection terminals 30. The position of the semiconductor package 60 is matched with the position of the socket 10 by the positioning part 40. Thereby, the adjacent pads 64 of the semiconductor package 60 match the first and the second connection parts 31*b*, 33*b* of each of the connection terminals 30.

Then, the semiconductor package 60 is pressed toward the mounting substrate 70 by rotating the lid part 82 in the direction of the thick arrow illustrated FIG. 22. The lid part 82 is fixed (locked) to the frame part 81 in a position in which the outer rim part of the lid part 82 contacts the top surface of the frame part 81. Thereby, the connection terminals 30 become compressed and contract in the Z direction. By compressing the connection terminals 30, a predetermined amount of resilient force is generated. Thereby, adjacent pads 64 of the semiconductor package 60 are electrically connected to the first and the second connection parts 31*b*, 33*b* of each of the connection terminals 30. In other words, the semiconductor package 60 is electrically connected to the mounting substrate 70 by way of the socket 10 as illustrated in, for example, FIGS. 3 and 4.

Hence, because plural signals can be transmitted with a single connection terminal 30 according to the above-described first embodiment of the present invention, a socket that is compatible to a narrow pitched LGA semiconductor package can be provided.

Further, in a case of transmitting single end signals with a single connection terminal 30, the signals can be shielded (blocked) at the GND. Thereby, the connection terminal 30 can be prevented from being adversely affected by, for example, cross-talk noise. Further, characteristic impedance using the microstrip line structure can be matched. Thus, transmission characteristics of single end signals can be improved to provide a high frequency bandwidth.

Further, in a case of transmitting differential end signals with a single connection terminal 30, the interval between one of the differential signals and the other one of the differential signals can be minimized. Thereby, the radiation noise of one of the differential signals and the radiation noise of the other one of the differential noise can be cancelled. Thus, transmission characteristics of differential signals can be improved to provide a high frequency bandwidth.

Further, pads of a narrow-pitched semiconductor package 60 or the like can be connected to pads of a wide-pitched mounting substrate 70 (e.g., motherboard) or the like owing to the connection terminal 30. In other words, pitch conversion can be achieved with the connection 25, terminal 30.

(First Modified Example of First Embodiment)

In a first modified example of the first embodiment, a connection terminal 90 having a part(s) different from that of the connection terminal 30 is described below. It is to be noted that, in the first modified example of the first embodiment, like components/parts are denoted by like reference numerals as those of the first embodiment and are not further explained.

Figure 23:
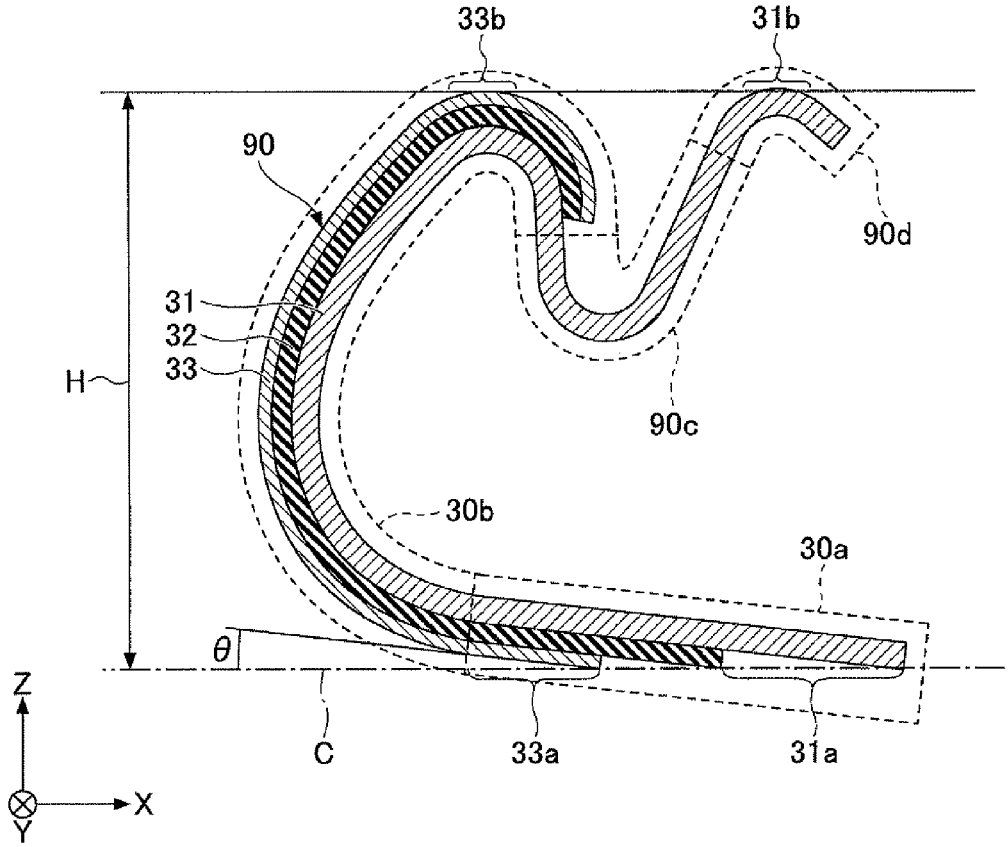
FIG. 23 is a cross-sectional view illustrating a connection terminal according to a first modified example of the first embodiment.

FIG. 23 is a cross-sectional view illustrating the connection terminal 90 according to the first modified example of the first embodiment. With reference to FIG. 23, the connection terminal 90 is different from the connection terminal 30 in that the connection part 30*c* is replaced with a connection part 90*c*, and the second bent part 30*d* is replaced with a second bent part 90*d*.

Only the shapes of the connection part 90*c* and the second bent part 90*d* are different from the shapes of the connection part 30*c* and the second bent part 30*d*. The functions of the connection part 90*c* and the second bent part 90*d* are substantially the same as the functions of the connection part 30*c* and the second bent part 30*d*. In the connection terminal 30, the first fixing part 31*a* is formed on the first surface of the metal plate 31 on one end of the metal plate 31 whereas the first connection part 31*b* is formed on the second surface of the metal plate 31 on the other end of the metal plate 31. In the connection terminal 90, the first fixing part 31*a* is formed on the first surface of the metal plate 31 on one end of the metal plate 31 whereas the first connection part 31*b* is formed on the first surface of the metal plate 31 on the other end of the metal plate 31. This difference is due to the below-described manufacturing process.

The connection terminal 90 is manufactured by performing substantially the same processes as those of the connection terminal 30. However, the shape of the inner side surface of the bending jig 100 illustrated in FIG. 15 is to be modified in correspondence with the configuration of the connection part 90*c* and the second bent part 90*d* of the connection terminal 90. Further, in the process illustrated in FIG. 17, the other end of the connection part 35 is to be inserted to the groove of the tip curling jig 110, and the tip curling jig 110 is to be turned in a direction opposite to the arrow direction 120 of FIG. 17 for bending the connection terminal 90.

Thereby, by adaptively modifying, for example, the shape of the inner side surface of the bending jig 100 and the bending direction of the tip of the connection part 35, the connection terminal 90 can be manufactured having a desired shape.

(Second Modified Example of First Embodiment)

In the above-described first embodiment, the positioning part 40 is provided on the substrate 20, and the position of the semiconductor package 60 is secured by the positioning part 40. In the second modified example of the first embodiment, the positioning part 40 is not provided on the substrate 20. Instead, a frame part 83 of a housing 80A is provided with a position securing function for securing the position of the semiconductor package 60. It is to be noted that, in the second modified example of the first embodiment, like components/parts are denoted by like reference numerals as those of the first embodiment and are not further explained.

Figure 24:
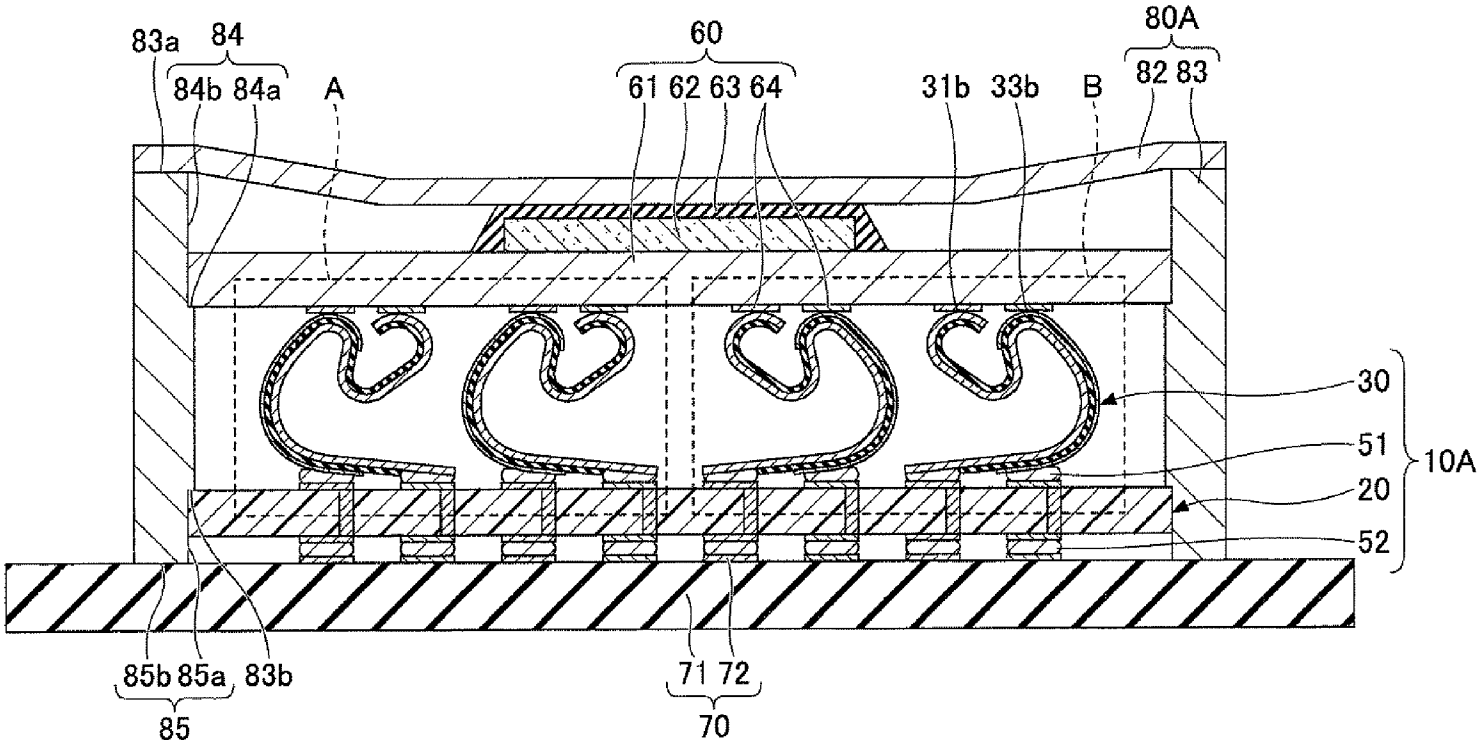
FIG. 24 is a cross-sectional view illustrating a socket according to a second modified example of the first embodiment.

FIG. 24 is a cross-sectional view illustrating a socket 10A according to the second modified example of the first embodiment. With reference to FIG. 24, the socket 10A is different from the socket 10 of the first embodiment (see, for example, FIGS. 3 and 4) in that no positioning part 40 is provided on the substrate 20, and the position of the semiconductor package 60 is secured by the frame part 83 of the housing 80A.

Figure 25A:
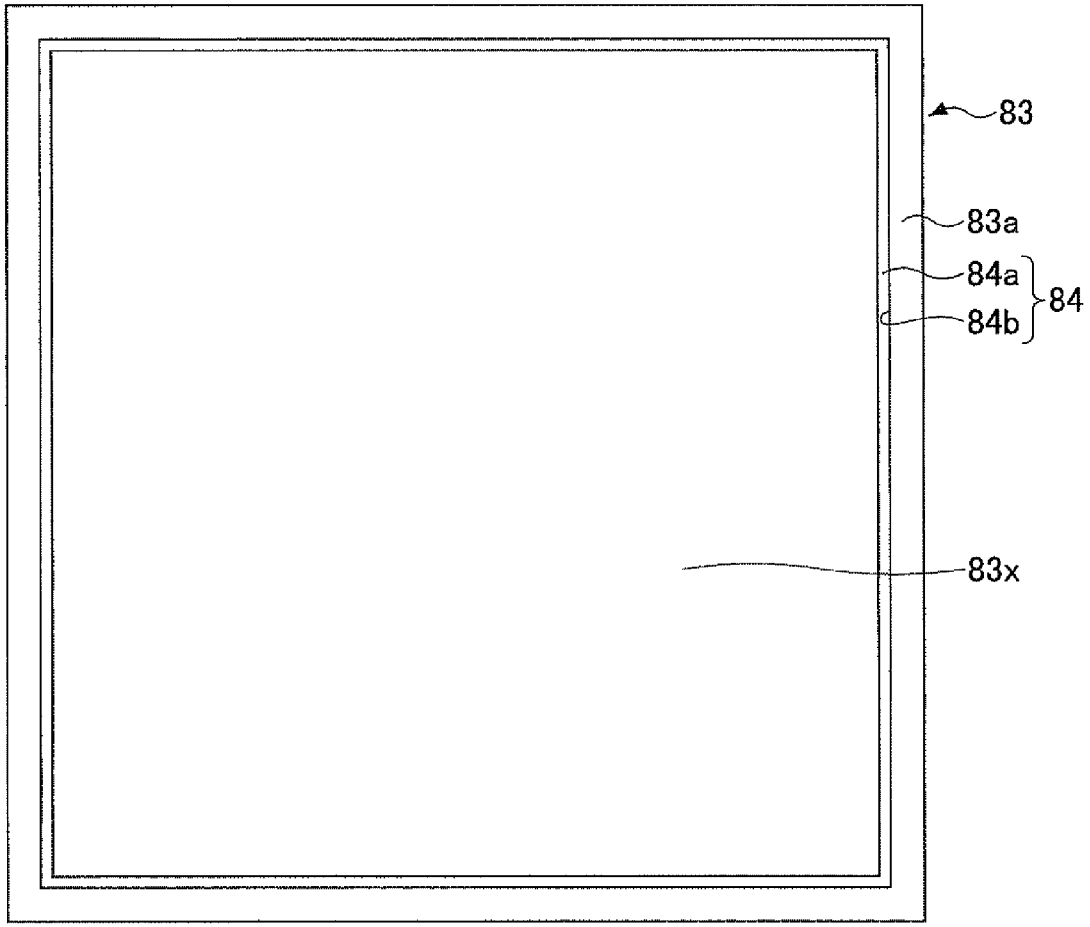
FIGS. 25A-25C are diagrams illustrating a frame part of a housing according to the second modified example of the first embodiment.
Figure 25B:
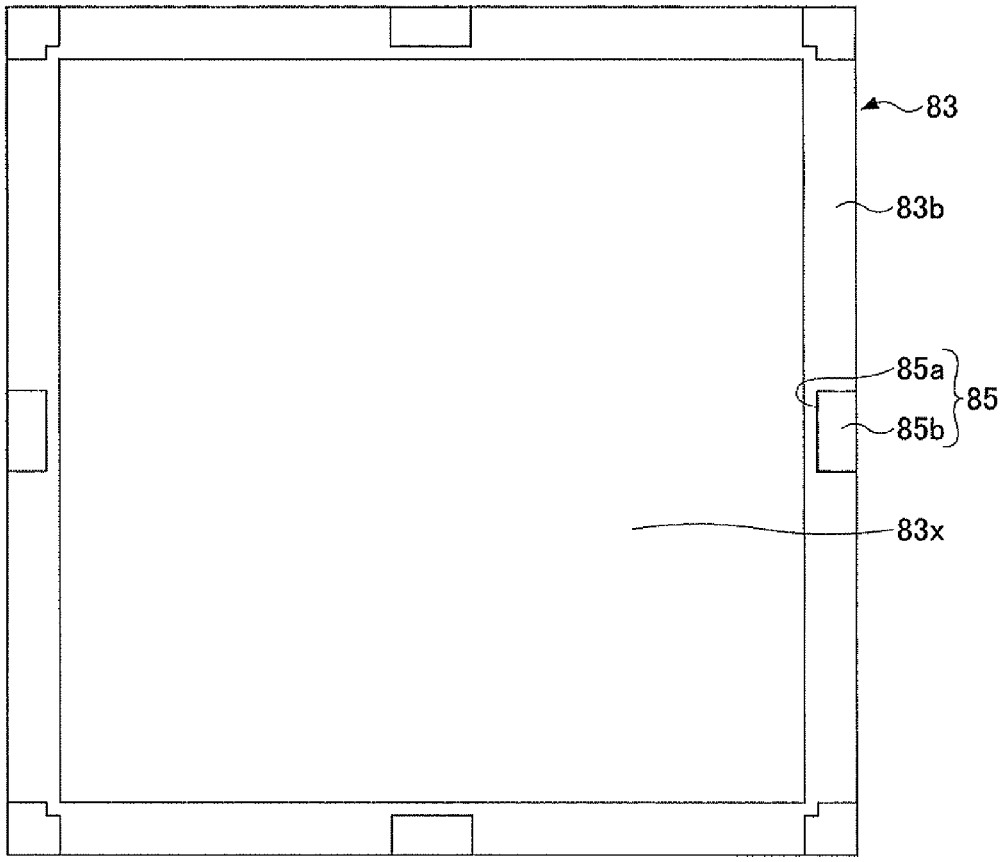
Figure 25C:
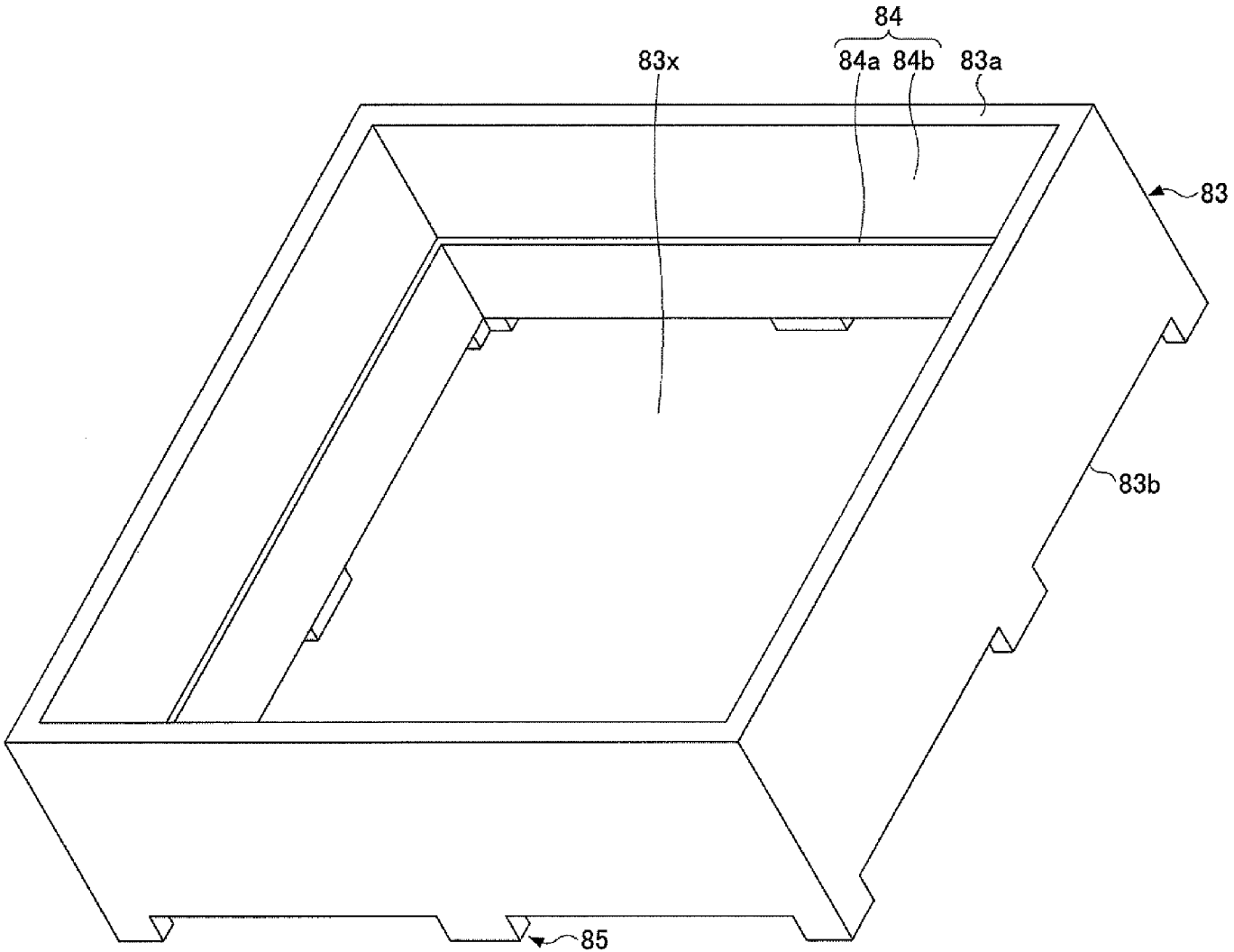

FIGS. 25A-25C are diagrams illustrating the frame part 83 of the housing 80A according to the second modified example of the first embodiment. FIG. 25A is a plan view of the frame part 83. FIG. 25B is a bottom view of the frame part 83. FIG. 25C is a perspective view of the frame part 83. With reference to FIGS. 25A-250, the frame part 83 includes a first position retaining part 84 and a second position retaining part 85. The first position retaining part 84 has a frame-like shape and includes a rectangular opening part 83*x* formed at its center. The frame part 83 is formed of, for example, a resin material or a metal material. The frame part 83 has a function of securing and retaining the position of the semiconductor package 60 and the substrate 20 and a function of matching the position between the semiconductor package 60 and the substrate 20. Further, the frame part 83 has a function of preventing the space between the semiconductor package 60 and the substrate 20 from become less than or equal to a predetermined value.

The first position retaining part 84 includes a first surface 84*a* and a second surface 84*b*. The first surface 84*a* is positioned more inward than a top surface 83*a* of the frame part 83 and one step lower than the top surface 83*a* of the frame part 83. The first surface 84*a* is substantially parallel to the top surface 83*a* and has a frame-like shape from a plan view. The second surface 84*b* is provided between the first surface 84*a* and the top surface 83*a* and is substantially perpendicular to the top surface 83*a*. The second surface 84*b* is a part of the inner side surface of the frame part 83.

The first surface 84*a* is in contact with an outer rim part of a bottom surface of the substrate 61 of the semiconductor package 60. An opening part of the first surface 84*a* has a rectangular shape matching the plan-view shape of the semiconductor package 60. The shape of the opening part of the first surface 84*a* is slightly larger than an outer shape of the substrate 61 for enabling detachable attachment of the semiconductor package 60. The second surface 84*b* and a side surface of the substrate 61 may contact each other. Alternatively, there may be a space between the second surface 84*b* and the side surface of the substrate 61 to an extent of not causing positional deviation between the first and the second connection parts 31*b*, 33*b* of the connection terminal 30 of the socket 10A and the adjacent pads 64 of the semiconductor package 60.

Because the semiconductor package 60 is retained by the first position retaining part 84, the semiconductor package 60 can be prevented from being pressed further than the first surface 84*a* of the first position retaining part 84 toward the mounting substrate 70. As a result, the semiconductor package 60 can be prevented from being pressed toward the mounting substrate 70 more than necessary. Accordingly, the connection terminal 30 can be prevented from being damaged due to being deformed (bent) more than necessary.

The second position retaining part 85 is a projecting part that projects from a bottom surface 83*b* of the frame part 83. In this embodiment, plural second position retaining parts 85 are provided at an outer rim part of the bottom surface 83*b*. Each of the second position retaining parts 85 includes an inner side surface 85*a* and a bottom surface 85*b*. In a state where the substrate 20 of the socket 10A is inserted and pressed against the frame part 83, the bottom surface 83*b* contacts an outer rim part of the top surface of the substrate 20, and the inner side surface 85*a* of the second position retaining part 85 contacts the side surface of the substrate 20.

An opening part of the inner side surface 85*a* has a rectangular shape matching the plan-view shape of the substrate 20. The shape of the opening part of the inner side surface 85*a* is substantially the same as an outer shape of the substrate 20 for enabling the substrate 20 to be inserted and pressed against the frame part 83. The length between the bottom surface 85*b* of the second position retaining part 85 and the bottom surface 83*b* of the frame part 83 is substantially equal to the length between the top surface of the mounting substrate 70 and the top surface of the substrate 20. The bottom surface 85*b* of the second position retaining part 85 contacts the top surface of the mounting substrate 70.

Although the frame part 83 is not directly fixed to the mounting substrate 70, the socket 10A is fixed to the mounting substrate 70 by the bonding part 52. Accordingly, the frame part 83, which has the substrate 20 inserted and pressed thereto, is indirectly fixed to the mounting substrate 70. Alternatively, instead of the configuration where the frame part 83 is indirectly fixed to the mounting substrate 70, the frame part 83 may be directly fixed to the top surface of the mounting substrate 70 by, for example, a bolt penetrating the mounting substrate 70.

In addition to attaining the same effects as the first embodiment, the second modified example of the first embodiment can also attain the following effects. First, the position of the semiconductor package (first connection object) 60 or the like can be secured without providing the positioning part 40 on the substrate 20.

Further, because the space between the semiconductor package (first connection object) 60 or the like and the substrate 20 can be prevented from becoming less than or equal to a predetermined value, the semiconductor package 60 or the like can be prevented from being pressed toward the mounting substrate 70 more than necessary. Accordingly, the connection terminal 30 can be prevented from being damaged due to being deformed (bent) more than necessary.

Hence, according to the above-described first embodiment or its modified examples, there can be provided a connection terminal, a method for manufacturing a connection terminal, and a socket including a connection terminal that can be used for a narrow-pitched LGA semiconductor package along with maintaining high frequency signals of the LGA semiconductor package having satisfactory transmission characteristics.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

For example, in the first embodiment or its modified examples, the connection terminal 30 may be provided on both surfaces (e.g., top and bottom surfaces) of the substrate 20, so that the connection terminal 30 provided on one surface of the substrate 20 achieves conductivity with respect to the semiconductor package 60 whereas the connection terminal 30 provided on the other surface of the substrate 20 achieves conductivity with respect to the mounting substrate 70. With this configuration, the substrate 20 can be detachably attached without being fixed to the mounting substrate 70. Therefore, the substrate 20 can be replaced with another substrate 20 even in a case where the connection terminal 30 is damaged.

Although the mounting substrate 70 (e.g., motherboard) is described as an example of the second connection object in the first embodiment and its modified examples, the second connection object is not limited to the mounting substrate 70 (e.g., motherboard). For example, the second connection object may be, for example, a substrate used for a semiconductor package test. In a case where the second connection object is a substrate used for a semiconductor package test, characteristics such as the electric characteristic of a semiconductor package can be repeatedly tested.

Further, the connection terminal 30 according to the first embodiment and its modified examples may be used as an interposer.

What is claimed is:

1. A connection terminal for connecting a first connection object and a second connection object, the connection terminal comprising:

a metal plate having a resilient property;

an insulating layer covering at least a part of the metal plate;

a conductive layer formed on at least a part of the insulating layer;

first and second fixing parts configured to be fixed to corresponding adjacent pads of the second connection object; and first and second connection parts configured to contact corresponding adjacent pads of the first connection object;

wherein the first fixing part and the first connection part are positioned opposite from each other;

wherein the second fixing part and the second connection part are positioned opposite from each other;

wherein the first and the second connection parts are faced outward to the first connection object;

wherein the first and the second fixing parts are faced outward to the second connection object.

2. The connection terminal as claimed in claim 1, wherein the metal plate has a narrow belt-like shape.

3. The connection terminal as claimed in claim 1, wherein the first fixing part corresponds to a first exposed part of the metal plate that is exposed from the insulating layer, the second fixing part corresponds to one part of the conductive layer, the first exposed part and the one part of the conductive layer being positioned adjacent to each other;

wherein the first connection part corresponds to a second exposed part of the metal plate that is exposed from the insulating layer, the second connection part corresponds to another part of the conductive layer, the second exposed part and the other part of the conductive layer being positioned adjacent to each other.

4. The connection terminal as claimed in claim 1, wherein the first and the second fixing parts are configured to be directly or indirectly fixed to corresponding adjacent pads of the second connection object.

5. The connection terminal as claimed in claim 1, wherein the first and the second connection parts are bent and projects in a direction opposite from the first and the second fixing parts.

6. The connection terminal as claimed in claim 1, wherein a bent part being positioned between the first and the second connection parts bends and projects in a direction from the first and the second connection parts to the first and the second fixing parts.

7. The connection terminal as claimed in claim 1, wherein a bent part being positioned between the first and the second fixing parts and the first and the second connection parts is bent into a shape of a letter C.

8. The connection terminal as claimed in claim 1, wherein the first and the second fixing parts have a flat shape.

9. The connection terminal as claimed in claim 1, wherein the first fixing part is formed on a first surface of the metal plate on one end of the metal plate;

wherein the first connection part is formed on a second surface of the metal plate on another end of the metal plate.

10. The connection terminal as claimed in claim 1, wherein the first fixing part is formed on a first surface of the metal plate on one end of the metal plate;

wherein the first connection part is formed on the first surface of the metal plate on another end of the metal plate.

11. A socket comprising:

a connection terminal for connecting a first connection object and a second connection object, the connection terminal including a metal plate having a resilient property, an insulating layer covering at least a part of the metal plate, a conductive layer formed on at least a part of the insulating layer, first and second fixing parts configured to be fixed to corresponding adjacent pads of the second connection object and first and second connection parts configured to contact corresponding adjacent pads of the first connection object;

wherein the first fixing part and the first connection part are positioned opposite from each other;

wherein the second fixing part and the second connection part are positioned opposite from each other;

wherein the first and the second connection parts are faced outward to the first connection object;

wherein the first and the second fixing parts are faced outward to the second connection object;

wherein the first and the second connection parts are configured to detachably attach the first and the second connection objects.

12. The socket as claimed in claim 11, further comprising:

a substrate having a surface to which the first and the second fixing parts are bonded; and a positioning part formed on an outer rim part of the surface of the substrate.

* * * * *